US005546911A

United States Patent [19]

Iwamoto et al.

[11] Patent Number: 5,546,911

[45] Date of Patent: Aug. 20, 1996

[54] FUEL INJECTION CONTROL APPARATUS

[75] Inventors: Shinji Iwamoto, Oobu; Toshiaki Mizuno, Kariya; Toshihiko Muramatsu, Chiryu; Kazushi Nakashima, Oobu; Tomoaki Abe, Chita-gun; Masao Yonekawa, Kariya; Yoshihiro Sakashita, Oobu, all of Japan

[73] Assignee: Nippondenso Co., Ltd., Kariya, Japan

[21] Appl. No.: 224,008

[22] Filed: Apr. 6, 1994

[30] Foreign Application Priority Data

| | | | |
|---|---|---|---|
| Apr. 20, 1993 | [JP] | Japan | 5-092957 |
| Sep. 16, 1993 | [JP] | Japan | 5-230166 |
| Sep. 22, 1993 | [JP] | Japan | 5-236326 |
| Dec. 22, 1993 | [JP] | Japan | 5-324070 |

[51] Int. Cl.[6] ..... F02M 37/04

[52] U.S. Cl. ..... 123/497; 123/465

[58] Field of Search ..... 123/465, 497, 123/514, 456, 506, 463

[56] References Cited

U.S. PATENT DOCUMENTS

| | | | |
|---|---|---|---|
| 3,820,517 | 6/1974 | Nambu | 123/465 |
| 3,967,598 | 7/1976 | Rachel | 123/497 |
| 3,970,063 | 7/1976 | Mayr | 123/465 |
| 4,625,696 | 12/1986 | Radaelli | 123/465 |
| 4,696,275 | 9/1987 | Kushi et al. . | |
| 5,018,500 | 5/1991 | Triolo et al. . | |
| 5,133,323 | 7/1992 | Treusch | 123/497 |
| 5,355,859 | 10/1994 | Weber | 123/497 |

FOREIGN PATENT DOCUMENTS

| | | |
|---|---|---|
| 289210 | 11/1988 | European Pat. Off. . |
| 59-180040 | 10/1984 | Japan . |
| 61-178526 | 8/1986 | Japan . |
| 64-32066 | 2/1989 | Japan . |
| 2052097 | 1/1981 | United Kingdom . |
| 2155994 | 10/1985 | United Kingdom . |

*Primary Examiner*—Carl S. Miller
*Attorney, Agent, or Firm*—Cushman, Darby & Cushman

[57] ABSTRACT

An improved fuel injection control apparatus, in which a reference pressure is provided to a pressure regulator, for simplifying the fuel supply system by preventing the fuel quantity injected from injection valves into an engine from being influenced by variations in the air intake pressure. A pressure regulating device disposed in a fuel supply pipe between a fuel pump and the fuel injection valve regulates the pressure of fuel supplied from the fuel pump to the fuel injection valve so that the pressure is proportional to the predetermined pressure, without returning fuel from the injection valve to the fuel tank. An intake pressure detecting device detects the pressure in the intake pipe, and a fuel injection quantity correcting device corrects the fuel injection quantity according to deviations of the fuel pressure regulated by the pressure regulating device from a proper value due to the differential pressure between the predetermined pressure of the pressure regulating means and the intake pressure. Accordingly, he fuel injection quantity injected from the injection valve is corrected based on the operating condition of the engine due to the variation of the intake pressure. As a result, the fuel supply system is simplified.

29 Claims, 34 Drawing Sheets

| NE (rpm) | NE0 | NE1 | .... | NEn |
|---|---|---|---|---|
| C1 | C11 | C12 | .... | C1n |
| C2 | C21 | C22 | .... | C2n |

| NE (rpm) | NEo | NE1 | NE2 | ..... | NEn |
|---|---|---|---|---|---|
| C10N | C10N0 | C10N1 | C10N2 | ..... | C10Nn |
| C20N | C20N0 | C20N1 | C20N2 | ..... | C20Nn |

| NE (rpm) | NEo | NE1 | NE2 | ..... | NEn |
|---|---|---|---|---|---|
| C10FF | C10FF0 | C10FF1 | C10FF2 | ..... | C10FFn |
| C20FF | C20FF0 | C20FF1 | C20FF2 | ..... | C20FFn |

FUEL INJECTION CONTROL APPARATUS

BACKGROUND OF THE INVENTION

1. Field of the Invention

The present invention generally relates to a fuel injection control apparatus for internal combustion engines, and, more particularly, to a fuel injection apparatus equipped with a pressure regulator in or in the vicinity of a fuel tank.

2. Description of the Related Art

Generally, an internal combustion engine equipped with an electronic fuel injection control apparatus includes a pressure regulator in or in the vicinity of an engine room, which utilizes the negative intake pressure as a control parameter for the fuel injection. This pressure regulator returns part of the fuel to the fuel tank through a return pipe when the pressure of fuel supplied from a fuel pump to a fuel injection valve rises higher than the pressure of an intake pipe, whereby the differential pressure between the intake negative pressure and the fuel pressure is maintained at a constant value.(as disclosed in the Japanese Unexamined Patent Publication No. 64-32066, etc.)

However, according to the above-described pressure regulator, the return pipe for returning part of the fuel to the fuel tank should be extended from the engine room generally provided in the front position of a vehicle to the fuel tank generally provided in the rear position of the vehicle. Therefore, the mounting efficiency of the pressure regulator is not sufficient.

To simplify the return pipe, a system wherein the pressure regulator is provided in or in the vicinity of the fuel tank is conceived. An object of such system is to eliminate an intake negative pressure introduction pipe, which extends from the pressure regulator to an intake manifold, such as a surge tank, for suppressing the pulsation in the intake manifold, by maintaining the differential pressure between the pressure around the pressure regulator and the fuel pressure instead of maintaining the differential pressure between the intake pressure and the fuel pressure at a constant value.

A problem with the above system is that, as the pressure of the fuel to be supplied to an injection valve is maintained constant in proportion to the pressure in or in the vicinity of the fuel tank, when the intake pressure varies, the fuel injection quantity varies, despite the open operation time of the injection valve remain unchanged.

SUMMARY OF THE INVENTION

It is a primary object of the present invention to provide an improved fuel injection control apparatus for internal combustion engines, in which the reference pressure other than the intake pressure is taken as the pressure around the pressure regulator (e.g., fuel tank pressure), having higher mounting efficiency by preventing the influence in fuel quantity to be injected from the injection valve into the engine even in a case where the intake pressure varies due to the intake pressure variance.

According to the first aspect of the present invention, as shown in FIG. 1, a fuel injection control apparatus for an internal combustion engine comprises a pressure regulating means disposed in a fuel supply pipe the between a fuel pump and a fuel injection valve for regulating the pressure of fuel to be supplied from the fuel pump to the fuel injection valve to be constant in proportion to a predetermined pressure, which is a pressure other than the pressure in an intake pipe, without returning fuel from the injection valve into a fuel tank. An intake pressure detecting means detects the pressure in the intake pipe, and a fuel injection quantity correcting means correct the fuel injection quantity of the fuel injection valve according to a deviation from a proper value of the fuel pressure regulated by the pressure regulating means due to the differential pressure between the predetermined pressure of the pressure regulating means and the intake pressure.

According to the second aspect of the present invention, a fuel injection control apparatus comprises an operating condition detecting means for detecting the operating conditions of the engine, which includes an intake pressure detecting the means for detecting pressure in an intake pipe and a rotational speed detecting means for detecting the rotational speed of the engine. An injection quantity correcting means corrects the fuel injection quantity based on detection results of the operating condition detecting means. An intake pressure correcting means corrects the intake pressure for those correction parameters which are calculated irrespective of the intake pressure among of all correction parameters.

According to the third aspect of the present invention, a fuel injection control apparatus comprises an operating condition detecting means for detecting operating condition of the engine, which includes an intake pressure detecting means for detecting the pressure in the intake pipe, a rotational speed detecting means for detecting the rotational speed of the engine and a high-temperature starting judging means for judging that the engine is in a high-temparature starting condition. An injection quantity corrects means for correcting the fuel injection quantity according to a differential pressure between the intake pressure detected by the intake pressure detecting means and the predetermined pressure of the pressure regulating means, and a changing means changes the correction amount by increasing the fuel injection quantity when it is judged that the engine is in the high-temparature starting condition by the high-temparature starting judging means.

According to the above-mentioned present inventions, when the fuel is supplied to the fuel injection valve, the pressure of which is regulated to be constant in proportion to the pressure other than intake pressure by the pressure regulating means disposed in the fuel tank or in the fuel pipe in the vicinity of the fuel tank, it is possible to correct the fuel injection quantity to be injected from the injection valve according to the variation of the intake pressure and the operating condition of the engine. As a result, the fuel pipe thereof is simplified.

BRIEF DESCRIPTION OF THE DRAWINGS

In the accompany drawings:

FIGS. 5, 5A and 5B are flowcharts showing the routine to be performed by the ECU 9 in the first embodiment;

FIGS. 10, 10A and 10B are flowcharts showing the routine to be performed by the ECU 9 of the second embodiment;

DETAILED DESCRIPTION OF THE PREFERRED EMBODIMENTS (FIRST EMBODIMENT)

Figure 1:
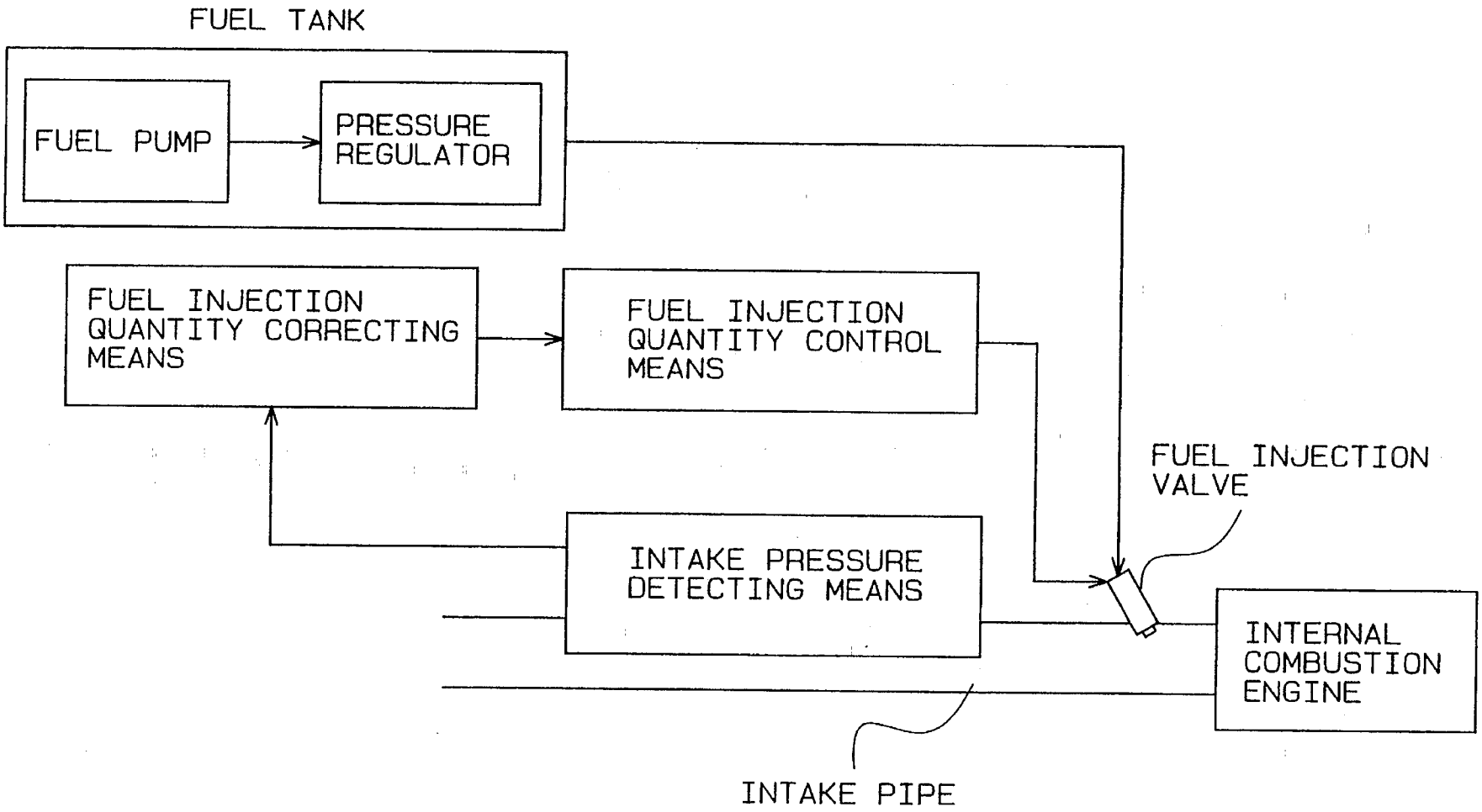
FIG. 1 is a schematic diagram showing the features of the present invention.
Figure 2:
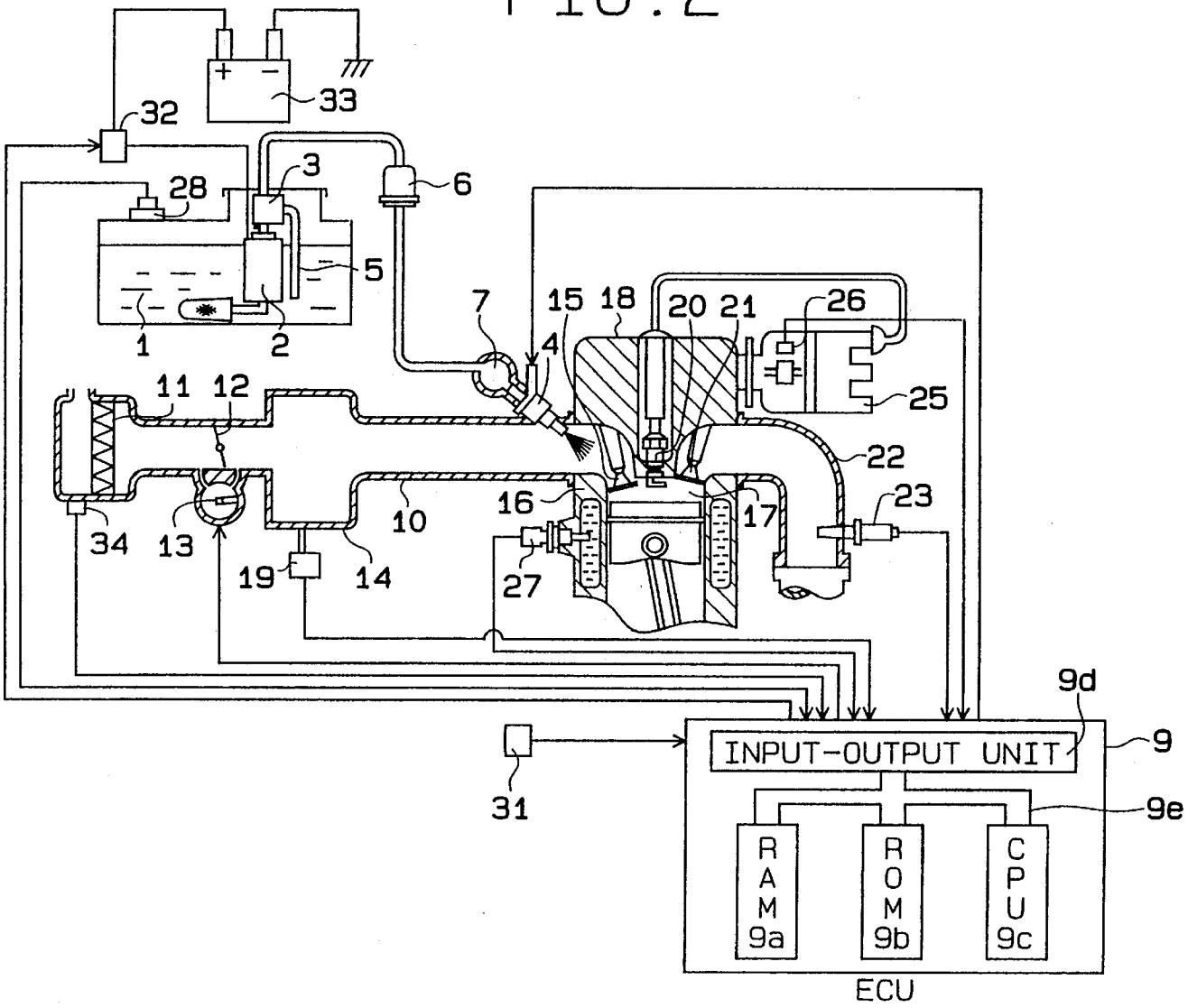
FIG. 2 is a view showing the configuration of the first embodiment according to the present invention.

FIG. 2 shows a configuration of the first embodiment equipped with a fuel injection control system which computes the fuel injection quantity based on an intake pressure for an internal combustion engine. In this first embodiment, a pressure regulator 3 and a fuel pump 2 are disposed in a fuel tank 1.

The fuel stored in the fuel tank is pumped up and pressurized by the fuel pump 2 and supplied to the pressure regulator 3. The fuel pump 2 is actuated by electric power supplied from a battery 33 according to the ON/OFF state of a relay 32. The pressure regulator 3 regulates the pressure of the fuel to be supplied to a fuel injection valve (injector) 4 disposed in an intake pipe in an upstream position of an intake valve 15 to be higher by a constant value than the pressure of the fuel tank 1 by returning part of the fuel to the fuel tank 1 through a return pipe 5. The detail description of the pressure regulator 3 is described later.

The fuel, the pressure of which is regulated by the pressure regulator 3 to a higher level by a constant value (e.g., 3.0 kg/cm2) than the pressure in the fuel tank 1, is supplied through a fuel filter 6 into a delivery pipe 7, and further to each injection valve 4 through the delivery pipe 7. Each injection valve 4 injects the fuel into each cylinder thereof at a predetermined injection quantity controlled by an electronic control unit (ECU) 9.

The fuel injected by the injection valve 4 is mixed with the air introduced through an air cleaner 11, a throttle valve 12, an idle speed control (ISC) valve 13 and a surge tank 14 disposed in an intake pipe 10, and further into a combustion chamber 17 in a cylinder 16 through the intake valve 15.

The throttle valve 12 controls the intake air quantity to be supplied into an engine 18, and the ISC valve 13 controls the rotational speed of the engine 18 in idling. On the other hand, the surge tank 14 for suppressing the pulsations of the intake air includes an intake pressure sensor 19 to detect the intake pressure in the intake pipe 10.

The fuel-air mixture supplied into the combustion chamber 17 in the cylinder 16 is compressed therein, ignited with sparks generated by an ignition plug 20, and explodes. The combustion gas is discharged as exhaust gas into an exhaust pipe 22 through an exhaust valve 21. At this time, the concentration of oxygen in the exhaust gas is detected by an oxygen concentration sensor ($0_2$ sensor) 23 mounted on the exhaust pipe 22.

A rotation angle sensor 26 is mounted on a distributor 25 supplying high voltage to the ignition plug 20 to detect the rotational speed and rotation angle of the engine 18. A water temperature sensor 27 is mounted on the cylinder 16 to detect the temperature of cooling water cooling the cylinder 16. Furthermore, a tank pressure sensor 28 is mounted on the top wall of the fuel tank 1 to detect the differential pressure between the atmospheric pressure and the fuel tank pressure. In this embodiment, the atmospheric pressure is detected by a known method (e.g., by detecting the intake pressure when a starter is in the ON state as the atmospheric pressure). An intake air temperature sensor 34 is mounted in the vicinity of the air cleaner 11 in the intake pipe 10 to detect the temperature of the air taken into the intake pipe 10. A starter switch 31 detects the operation of the starter (not shown), and when the starter is in operation, the starter switch 31 is in the ON state.

The ECU 9 comprises a random access memory (RAM) 9*a* for storing and/or updating information from each sensor at any time, a read only memory (ROM) 9*b* for maintaining various control programs, control tables, etc., a center processing unit (CPU) 9*c* for performing various computations, an input-output unit 9*d* for exchanging various data, and a common bus 9*e* for connecting these units.

The ECU 9 carries out the air fuel ratio feedback control of the engine 18 according to the outputs from the $O_2$ sensor 23. Furthermore, the ECU 9 carries out the injection timing and quantity control of the injection valve 4, the ISC control, etc. based on the signals from the rotation angle sensor 26, the water temperature sensor 27, the tank pressure sensor 28, the intake pressure sensor 19, etc.

Figure 3:
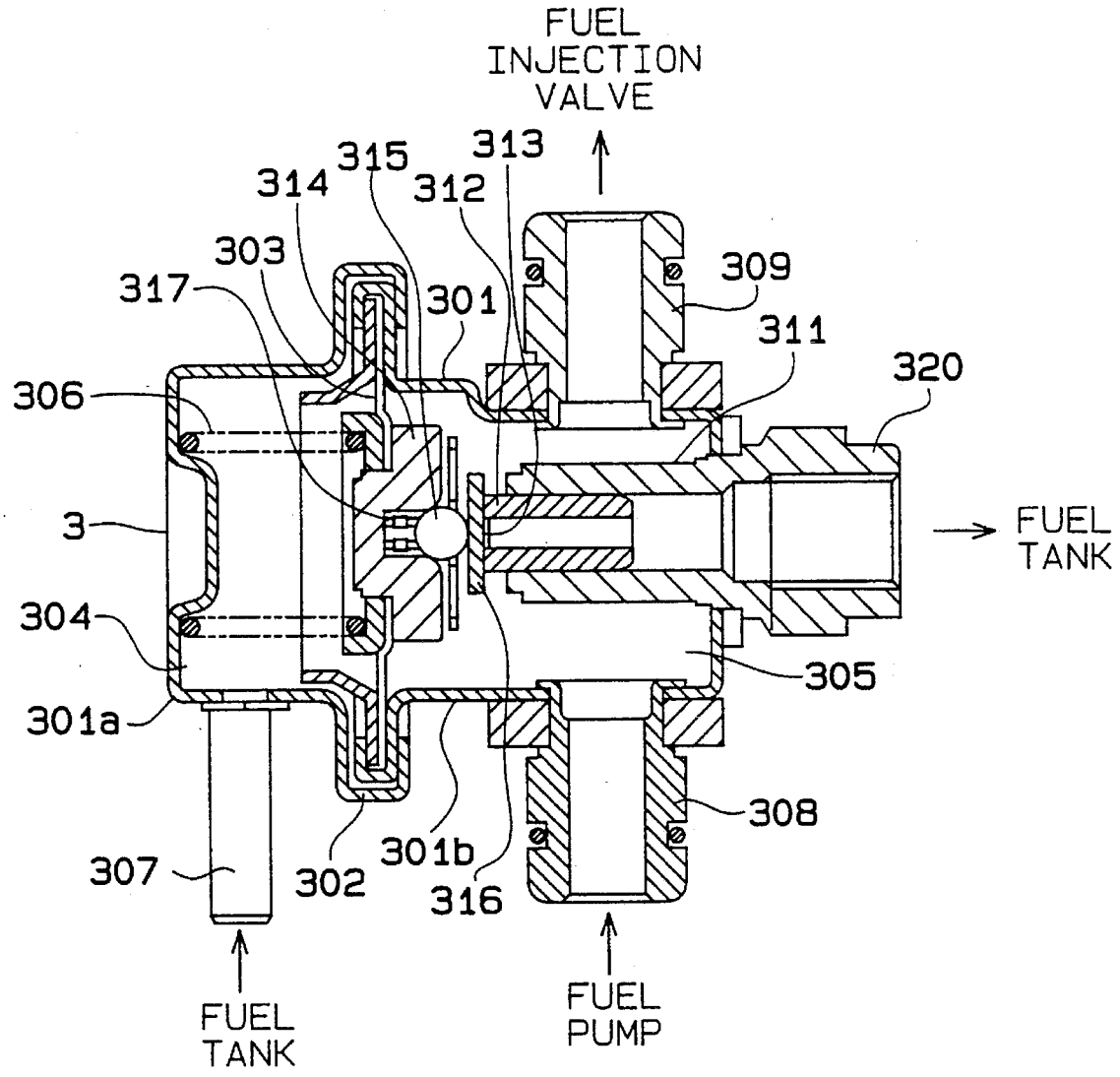
FIG. 3 is a cross-sectional view showing the pressure regulator 3 in the first embodiment.

The structure and operation of the pressure regulator 3 according to the first embodiment is explained with respect to FIG. 3.

First, the structure of the pressure regulator 3 is described.

A housing 301 of the pressure regulator 3 is formed by abutting the halves of the first and second frames 301*a* and 301*b*, which are divided in the axial direction, against one another. The first and second frames 301*a* and 301*b* are joined so as to fit each other at folded ends 302. Furthermore, the brim part of a diaphragm 303 is nipped in an airtight seal between the abutting surfaces of the first and second frames 301*a* and 301*b*. The diaphragm 303 divides the housing 301 into a diaphragm chamber 304 and a fuel chamber 305 in the axial direction.

A compression coil spring 306 is housed in the diaphragm chamber 304 so as to apply pressure to the diaphragm 303 toward the fuel chamber 305. An ambient pressure introduction pipe 307 is fixed to the first frame 301*a* and connected to the diaphragm chamber 304 to introduce the tank pressure from the fuel tank 1 thereinto. Furthermore, the other end of the ambient pressure introduction pipe 307 extends vertically downwards into the fuel tank 1 in such a manner that the bottom end of the ambient pressure introduction pipe 307 does not go under the fuel even when the fuel tank 1 is filled up with fuel. According to this vertical and downward installation, even when fuel splashes up into the ambient pressure introduction pipe 307 due to vibration, etc., the fuel does not stay therein but falls back into the fuel tank 1 immediately.

An inflow connection pipe 308 fixed to the second flame 301*b* and connected to a fuel inflow pipe, an outflow connection pipe 309 connected to a fuel outflow pipe, and a returning connection pipe 320 connected to the return pipe 5 are connected to the fuel chamber 305. The inflow connection pipe 308 and the outflow connection pipe 309 are connected to the bottom and top walls of the second flame 301*b* respectively, and the returning connection pipe 320 is mounted on the side wall of the second flame 301b. The returning connection pipe 320 is disposed in the center axis of the housing 301.

A cylindrical division tube 311 is provided in the fuel chamber 305. A valve seat 312 is fixed to the inner open end of the division tube 311, and a valve hole 313 is bored in the center portion of the valve seat 312. That is, the inflow connection pipe 308 and the returning connection pipe 320 are connected to each other through the valve hole 313.

On the other hand, a valve holder 314 is mounted in the center portion of the diaphragm 303, and a ball 315 is rotatably supported by the valve holder 314. Furthermore, a plate-like valve element 316 is fixed to the ball 315. A spring applies pressure to the ball 315.

The valve element 316 is disposed so as to face the valve seat 312. When the valve element 316 is positioned near the valve seat 312 by the deflection of the diaphragm 303, the open area of the valve hole 313 at the side of the valve element 316 is decreased to reduce the fuel quantity to be returned to the fuel tank 1 and increase the fuel pressure.

The operation of the pressure regulator 3 having the above structure is described.

Fuel supplied from the fuel pump 2 into the injection valve 4 is pumped into the fuel chamber 305 in the pressure regulator 3 through the inflow connection pipe 308. The pressure of the fuel to be supplied into the injection valve 4 is controlled by the pressure regulator 3. That is, when the fuel pressure in the fuel chamber 305 becomes relatively higher than the fuel pressure in the fuel tank 1 to be introduced into the diaphragm chamber 304 through the ambient pressure introduction pipe 307, this higher fuel pressure deforms the diaphragm 303 against the pressing force of the compression coil spring 306.

As a result, the valve holder 314 and the valve element 316 separate from the valve seat 312, and the valve hole 313 opens. Then, the fuel in the fuel chamber 305 flows from the valve hole 313 into the returning connection pipe 320 through the partition tube 311, and further into the fuel tank 1 from the returning connection pipe 320. Therefore, the pressure of the fuel to be supplied from the fuel pump 2 into the injection valve 4 is reduced.

On the other hand, when the pressure of the fuel in the fuel chamber 305 becomes relatively lower than the pressure in the fuel tank 1, the diaphragm 303 is pressed by the compression coil spring 306, and the valve holder 314 and the valve element are displaced towards the valve seat 312. When the valve element 316 is positioned near the valve seat 312, the open area of the valve hole 313 is decreased, and the fuel flow from the fuel chamber 305 is raised. Therefore, the pressure of the fuel to be supplied from the fuel pump 2 into the injection valve 4 is raised.

Thus, the pressure of the fuel to be pumped into the fuel chamber 305 in the pressure regulator 3 is maintained so as to be constant in proportion to the pressure in the fuel tank 1, and the pressure of the fuel to be supplied into the injection valve 4 through the outflow connection pipe 309 is kept constant.

As described above, the pressure regulator 3 in this embodiment regulates the pressure of the fuel to be supplied into the injection valve 4 to a higher level by a constant value in proportion to the pressure in the fuel tank 1. The pressure in the fuel tank 1, however, is not always constant, i.e., when the pressure in the fuel tank 1 varies due to the variation in the vaporized fuel quantity according to the ambient temperature, the variation in the atmospheric pressure, etc., the pressure of the fuel to be supplied into the injection valve 4 also varies.

The fuel quantity to be injected from the injection valve 4 is determined by the open area and open time of the injection valve 4 and the velocity of the fuel at the time of injection. For this reason, when the fuel pressure or the intake pressure varies, as a result, the fuel velocity varies, and the fuel quantity to be injected varies even when the open area and open time of the injection valve 4 remain unchanged.

The principle of correction of the fuel injection quantity when the fuel velocity varies (due to the variation in the intake pressure, the fuel tank pressure, etc.) is explained below. In the first embodiment, the basic fuel injection time $T_{PO}$ is determined by referring to a table of the intake pressure and the rotational speed of the engine. As this table has been prepared by measuring the necessary fuel injection time based on the actual intake pressure and the rotational speed of the engine, the correction of the deviation from the proper value of the pressure regulation by the pressure regulator 3 is automatically performed at the same time as the above according to the variation in the intake pressure. For this reason, as to the basic fuel injection time $T_{PO}$, there is no need to perform the correction for the variation in the intake pressure. Therefore, the correction for the fuel injection quantity according to the variation in the fuel tank pressure is explained as below.

The ECU 9 computes the fuel injection time based on a condition that the pressure of the fuel to be supplied into the injection valve 4 is constant (i.e., absolute pressure). If the ECU 9 computes commands fuel injection with a valve open time of minutes $\tau$ based on a condition that the pressure of the fuel supplied into the injection valve 4 is constant, the fuel injection quantity is equal to $qs\tau$ wherein, s denotes the open area and q denotes the velocity of the fuel injected from the injection valve 4. In this embodiment, however, the fuel pressure is not constant for the above reasons. When the velocity of the fuel injected from the injection valve, is equal to q', then the fuel injection quantity is $q's\tau$. That is, an error is caused by the variation in the fuel velocity.

In order to eliminate this error, the actual fuel injection quantity $q's\tau$ should be divided by the velocity q' at that time and further multiplied by the velocity q at the fuel pressure that the ECU 9 computes as constant. By this correction, the target fuel injection quantity $qs\tau$ is obtained. That is, the correction for the variation of the pressure in the tank is performed by multiplying the fuel injection time by the correction value q/q' as the coefficient of the correction.

Where the pressure of the fuel supplied into the injection valve 4 is p, the pressure in the intake at which the injection valve 4 injects the fuel is $p_m$, and the fuel density is $\rho$, the velocity q can be expressed by the following equation:

$$q=\sqrt{\frac{2(P-P_m)}{\rho}} \tag{1}$$

When the fuel pressure is p' the velocity q' is expressed by the following equation:

$$q'=\sqrt{\frac{2(P'-P_m)}{\rho}} \tag{2}$$

Therefore, q/q' is expressed by the following equation:

$$q/q'=\sqrt{\frac{P-P_m}{P'-P_m}} \tag{3}$$

If the atmospheric pressure is $p_a$, the differential pressure between the tank pressure and the atmospheric pressure is $P_t$, the intake pressure is $p_m$, and the preset pressure of the pressure regulator 3 is $P_f$, Equation (3), i.e, the differential correction coefficient q/q', is expressed by the following equation:

$$q/q'=\sqrt{\frac{760-P_f-P_m}{P_t+P_a+P_f-P_m}} \tag{4}$$

Hereinafter, this coefficient of correction is denoted as the coefficient of tank pressure $K_{TP}$.

Figure 4:
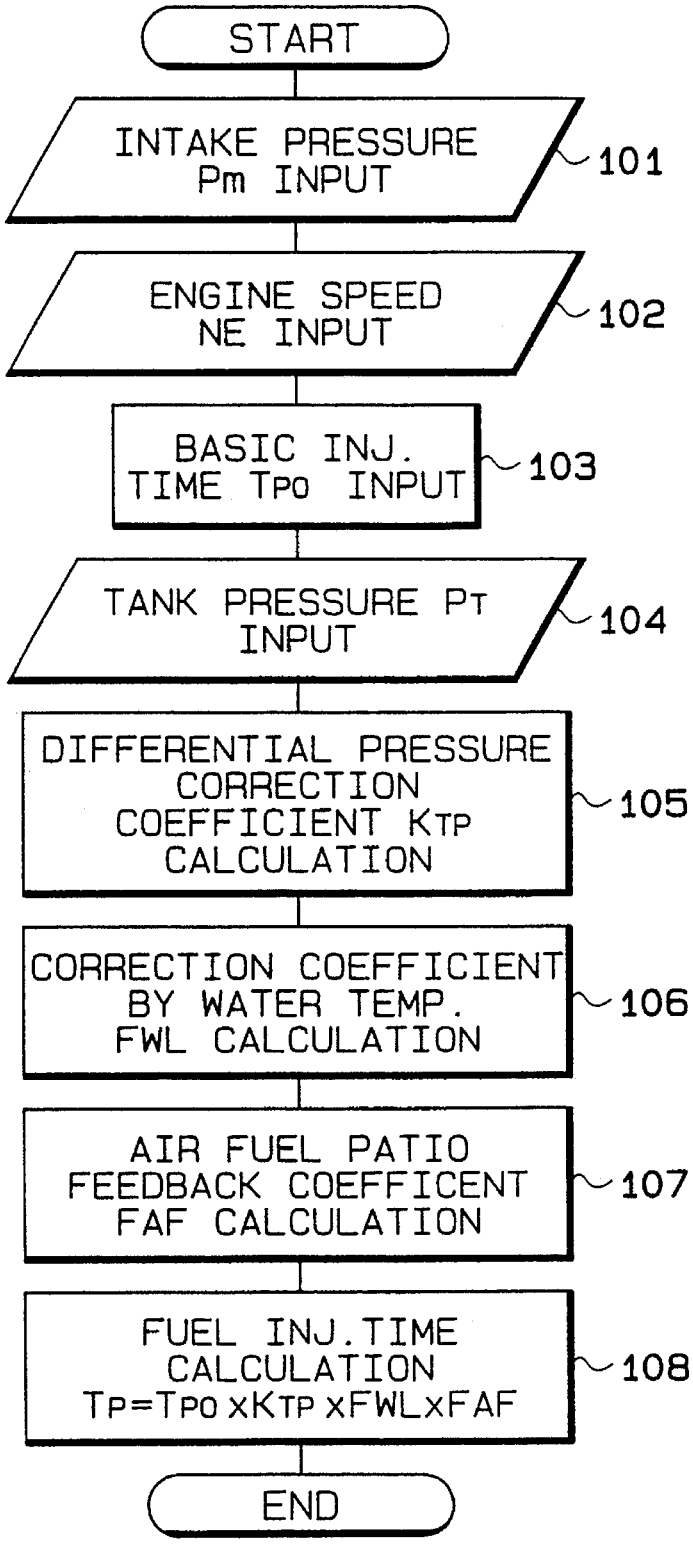
FIG. 4 is a flowchart showing the routine to be performed by the ECU 9 utilized in the first embodiment.

The flowchart of the fuel injection time calculation performed by the ECU 9 is explained with respect to FIG. 4.

When the fuel injection time computation routine is started, first, at Step 101, the intake pressure $p_m$ is input from the intake pressure sensor 19. At Step 102, the rotational speed of the engine NE is computed based on the signals from the rotation angle sensor 26, and the results are inputted. Then, at Step 103, the basic injection time corresponding to the intake pressure $p_m$ and the rotational speed of the engine NE is obtained from the injection quantity table preset in the memory of the ECU 9. At this time, this injection quantity table stores the fuel injection quantity corrected based on the fuel quantity according to the deviation from the proper value of the fuel pressure regulated by the pressure regulator 3 according to the variation in the intake pressure $p_m$.

At Step 104, the tank pressure $P_t$ is input from the tank pressure sensor 28. At Step 105, the coefficient of tank pressure correction $K_{TP}$ is obtained by using Equation (4) for the correction for the variation in the fuel injection quantity according to the variation in the tank pressure.

Then, at Step 106, the coefficient of water temperature correction FWL according to the cooling water temperature based on the signals from the water sensor 27 is obtained. At Step 107, the coefficient of feedback FAF for the air fuel ratio feedback is obtained based on the signals from the $O_2$ sensor 23. Then, at Step 108, these coefficients are multiplied by the basic injection time, and the fuel injection time TP is obtained by using the following equation, and then this process is terminated:

$$T_P=T_{PO}\times K_{TP}\times FWL\times FAE \tag{5}$$

By processing the above steps, the fuel injection quantity error due to the variation in the tank pressure or the intake pressure is corrected.

In this embodiment, the intake pressure sensor 19 corresponds to and functions as the intake pressure detecting means, and the process at Step 108 functions as the fuel injection quantity controlling means, and the process at Step 105 functions as the fuel injection correcting means.

In this embodiment, though the intake pressure when the starter is in the ON state is taken as the atmospheric pressure, an atmospheric pressure sensor may be provided to detect the atmospheric pressure instead. Although the tank pressure sensor for detecting the differential pressure between the atmospheric pressure and the tank pressure is utilized, the tank pressure may be detected as the absolute pressure. If such sensor is utilized, there is no need to detect the atmospheric pressure, and therefore the means for detecting the atmospheric pressure is eliminated.

Figure 5A:
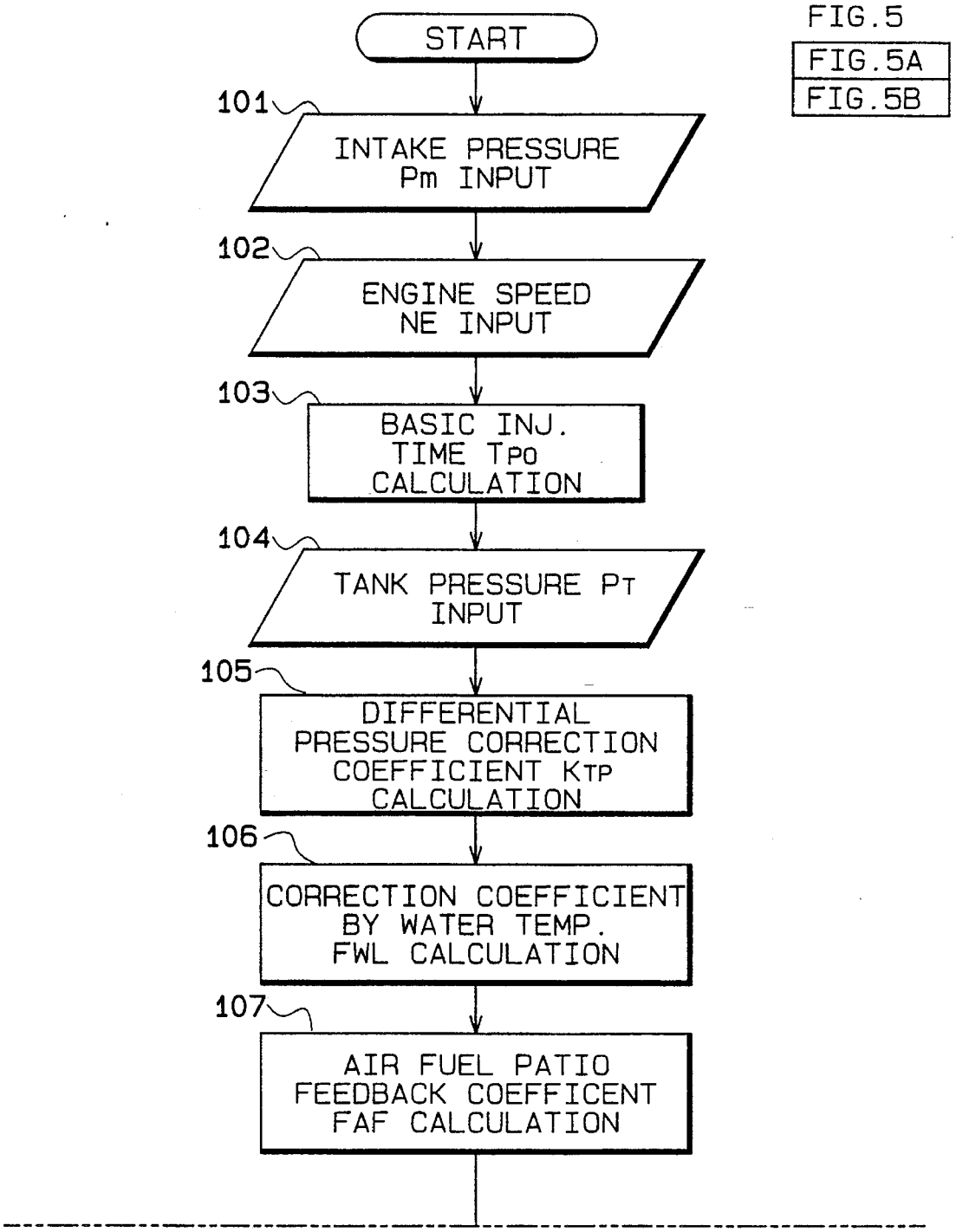
Figure 5B:
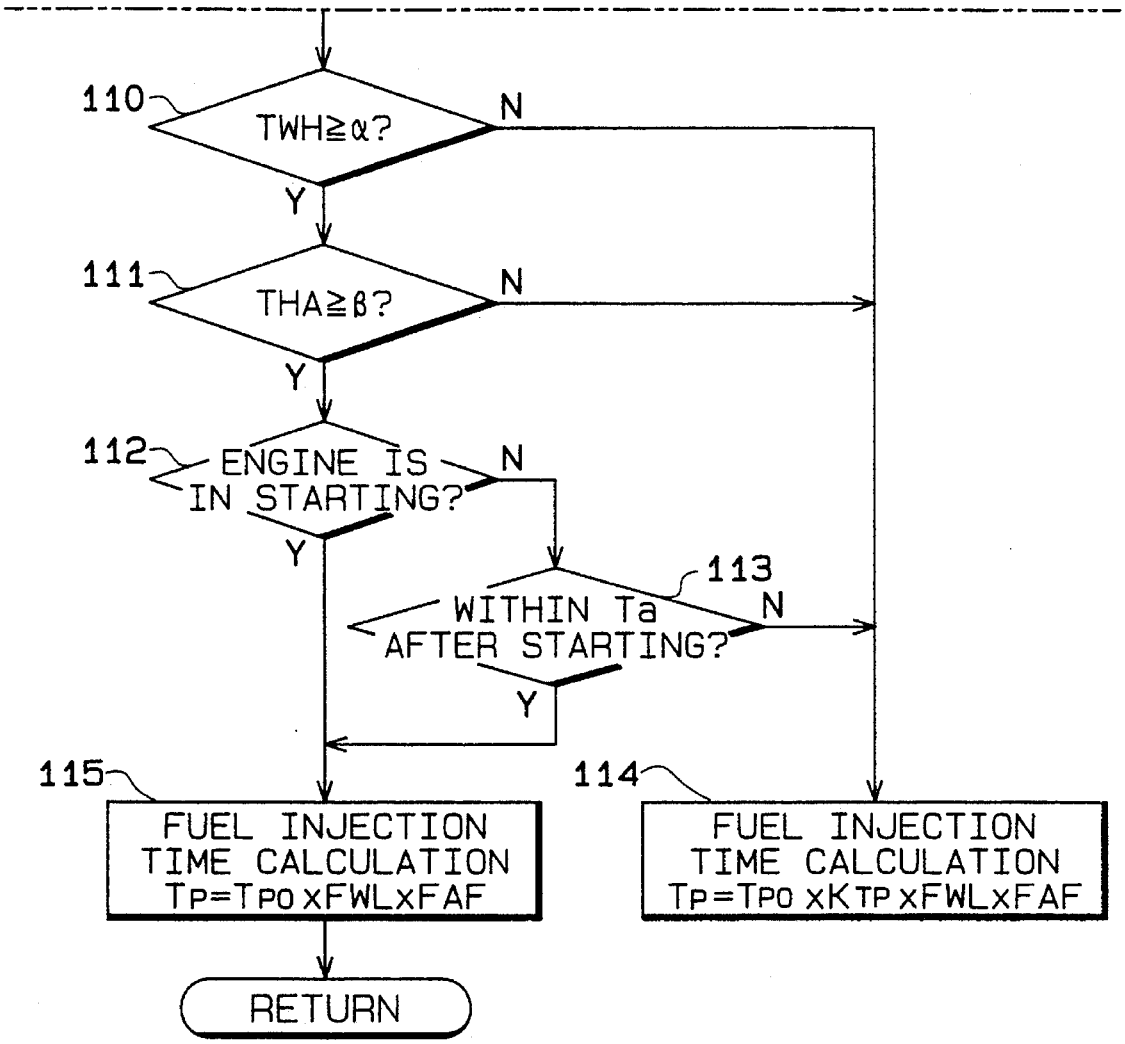

In addition to the control in the first embodiment as described above, the injection quantity control when the engine is in high-temperature starting condition is explained with respect to the flowchart shown in FIGS. 5A and 5B. The steps in FIG. 5A that are identical to those in FIG. 4 are identified by the same reference numerals, and a detailed discussion thereof is omitted.

After the coefficient of feedback FAF for the air fuel ratio feedback is computed at Step 107, the ECU 9 judges at Step 110 whether or not the cooling water temperature TWH previously input is equal to or higher than the predetermined temperature $\alpha$ (e.g., 100° C.). If the cooling water temperature TWH is not equal to or higher than the predetermined temperature α, the ECU 9 judges that the engine is not in a high temperature starting condition. Then, the ECU 9 computes the fuel injection time $T_P$ based on the previously computed basic injection time $T_{PO}$, coefficient of differential pressure correction $K_P$, coefficient of water temperature correction FWL and coefficient of air fuel ratio feedback FAF and by using Equation (5), and then terminates this routine.

On the other hand, at Step 110, if the cooling water temperature TWH is equal to or higher than the predetermined temperature α, the ECU 9 proceeds to Step 111, and judges whether or not the intake air temperature THA based on the detected signals from the intake air temperature sensor 30 is equal to or higher than the predetermined temperature β (e.g., 60° C.). When the intake air temperature THA is not equal to or higher than the predetermined temperature, the ECU 9 judges that the engine is not in a high temperature starting condition and proceeds to Step 114, and computes the fuel injection time $T_P$ by using Equation (5).

When the intake air temperature THA is equal to or higher than the predetermined temperature β, the ECU 9 proceeds to Step 112, and judges whether or not the engine is in starting. The judgment whether or not the engine is starting is based on the judgment whether or not the starter switch 31 is in the ON state and the rotational speed of the engine NE previously inputted is equal to or smaller than the predetermined rotational speed (e.g., 500 rpm). At this step, the ECU 9 judges that the engine is in a high-temperature starting condition, and then proceeds to Step 115.

When the engine is not starting, the ECU 9 proceeds to Step 113, and judges whether or not the time passed after starting is within the predetermined time Ta (e.g., 120 seconds), whereas the time passed after starting means the time after the starter switch 31 in the ON state is turned OFF. When the time passed after starting is not within the predetermined time Ta, the ECU 9 judges that the engine is not in high-temperature starting condition, proceeds to Step 114, and computes the fuel injection time $T_P$ by using above Equation (5). When the time passed after starting is within the predetermined time Ta, the ECU 9 judges that the engine is in a high-temperature starting condition, and proceeds to Step 115.

At Step 115, the ECU 9 computes the final fuel injection time $T_P$ based on the previously computed basic injection time $T_{PO}$, coefficient of water temperature correction FWL and coefficient of air fuel ratio feedback FAF and by using the following equation, and temporarily terminates this process.

$$T_P = T_{PO} \times FWL \times FAF \tag{6}$$

That is, when the ECU 9 judges that the engine is in a high-temperature starting condition, the ECU 9 does not perform the correction with the coefficient of differential pressure correction $K_{TP}$ in computing the final fuel injection time $T_P$ in order to extend the valve open time of the injection valve 4, i.e., the fuel injection time.

As described above, in this embodiment, when the ECU 9 judges that the engine is in a high temperature starting condition, the ECU 9 does not perform the correction with the coefficient of differential pressure correction $K_{TP}$ in computing the final fuel injection time $T_P$. For this reason, even in a high-temperature starting condition, which may easily sustain the shortage of the fuel injection quantity due to the influence of the vapor contained in the fuel supplied to the injection valve 4, there is no possibility of the shortage of the actual fuel injection quantity from the injection valve 4. Accordingly, the fuel injection quantity shortage in high-temperature starting is eliminated, a good starting ability is obtained, and the idling condition is prevented from being instable.

(SECOND EMBODIMENT)

As the second embodiment, the present invention is applied to an engine provided with a fuel injection control system which computes the fuel injection quantity based on the intake air quantity.

Figure 6:
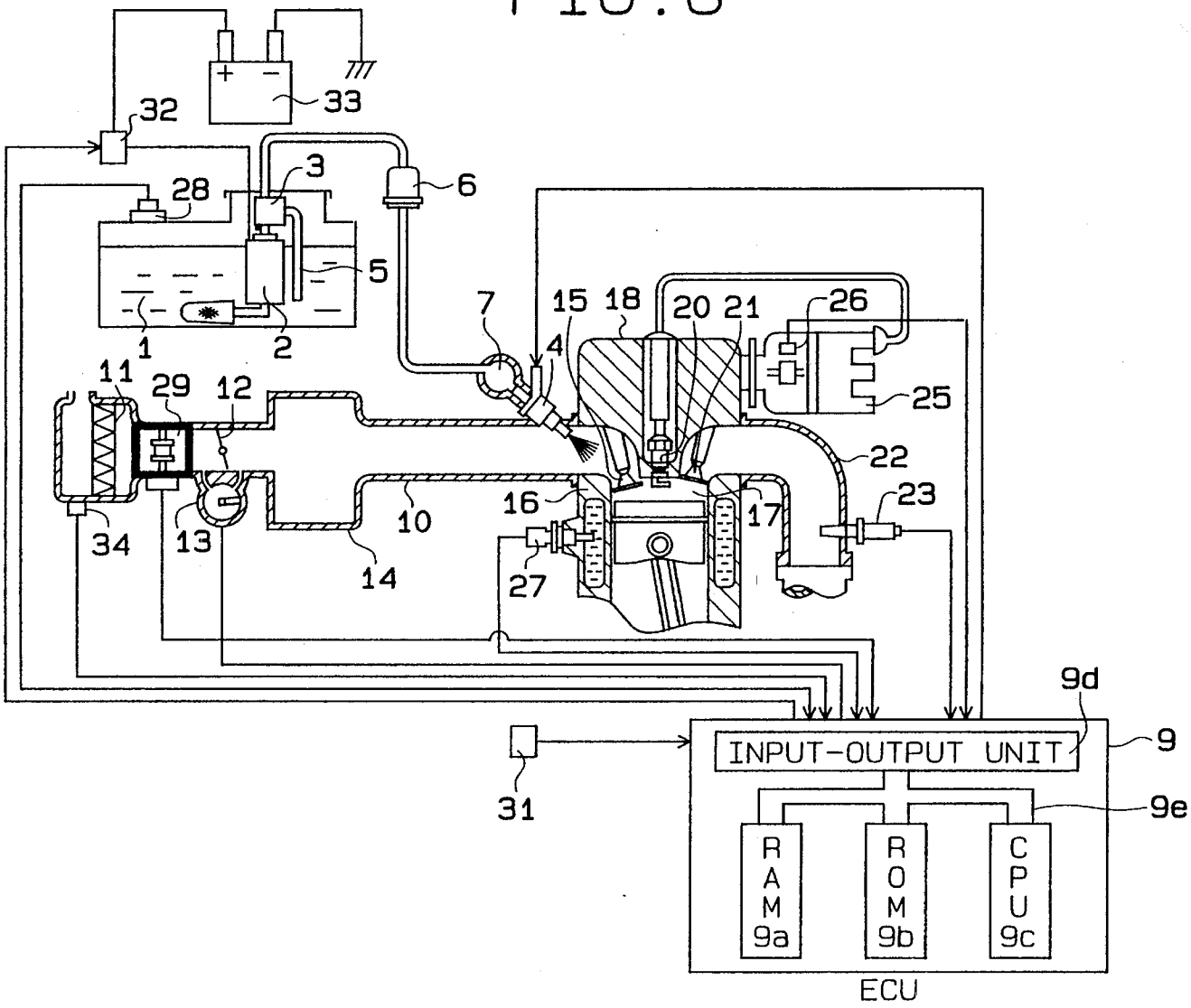
FIG. 6 is a view showing the configuration of the system of the second embodiment.

FIG. 6 shows the configuration of the second embodiment. In this embodiment, an air flow meter 29 is mounted downstream of the air cleaner 11 in the intake pipe 10 to detect the intake air quantity, instead of the intake pressure sensor 19 in the first embodiment. The ECU 9 computes the basic fuel injection time $T_{POGA}$ based on the intake air quantity detected by the air flow meter 29 and the rotational speed of the engine NE detected by the rotation angle sensor 26. In the first embodiment, the intake pressure when the starter is in the ON state is taken as the atmospheric pressure. In the second embodiment, however, as no intake pressure sensor is provided, this method is not available. Therefore, instead of this method, in the second embodiment, the intake pressure estimated when the throttle is fully open is taken as the atmospheric pressure.

In the fuel injection control system described above, as the correction for the intake pressure is not performed in computing the basic fuel injection time $T_{POGA}$, such correction should be performed. The computation of the fuel injection time including the correction for the intake pressure is explained with respect to the flowchart shown in FIG. 8.

When the fuel injection time computation routine is started, first, at Step 121, the intake air quantity Ga is input. At Step 122, the rotational speed of the engine NE is inputted. At Step 123, the basic injection time $T_{POGA}$ is read from the one-dimensional table of the value obtained by dividing the intake air quantity by the rotational speed of the engine NE. At Step 124, the tank pressure $P_T$ is inputt. At Step 125, the estimated intake pressure $P_{m(i)}$ obtained by following the flowchart shown in FIG. 9 (described later) is input. At Step 126, the coefficient of intake pressure correction $K_{pm}$ for correcting the variance in the fuel injection quantity according to the intake pressure is obtained. As a matter of fact, though the coefficient of intake pressure correction $K_{pm}$ is obtained by using equation (7), the value pre-computed is stored in the ROM **9*b*** as the one-dimensional table of the intake pressures, and the value according to the intake pressure is input at any time.

$$K_{pm} = \sqrt{\frac{P_f}{P_f + (P_a - P_m)}} \tag{7}$$

wherein, Pt denotes the preset fuel pressure, $P_a$ denotes the atmospheric pressure, and $P_m$ denotes the intake pressure.

Then, at Step 127, the coefficient of water temperature correction FWL according to the cooling water temperature is obtained based on the signals from the water temperature sensor 27. First, at Step 128, the coefficient of feedback FAF for the air fuel ratio feedback based on the signals from the $O_2$ sensor is obtained. At Step 129, the fuel injection time $T_{PGA}$ is obtained by multiplying these coefficients of corrections by the basic injection time $T_{POGA}$ according to the following equation, and this process is terminated.

$$T_{PGA} = T_{POGA} \times K_{pm} \times FWL \times FAE \tag{8}$$

By processing the above steps, the correction for fuel quantity error according to the deviation from the proper value of the fuel pressure regulated by the pressure regulator 3 according to the variation in the intake pressure is performed.

In the above embodiment, though the ambient pressure introduction pipe 307 of the pressure regulator 3 is open into the fuel tank, the differential pressure between the tank pressure and the atmospheric pressure is small. For this reason, the atmospheric pressure is used as the reference pressure for the preset fuel pressure. Accordingly, the tank pressure input in Step 124 is not used in this process. For this reason, the pressure sensor 28 in the tank 13 is not always necessary. However, the tank pressure sensor 28 is necessary when the correction is performed for the fuel injection quantity according to the variation in the tank pressure as well as the variation in the intake pressure by using the tank pressure. The correction in this case is expressed by the following equation:

$$K_{pm}=\sqrt{\frac{P_f}{P_f+(P_t-P_m)}} \tag{9}$$

Figure 9:
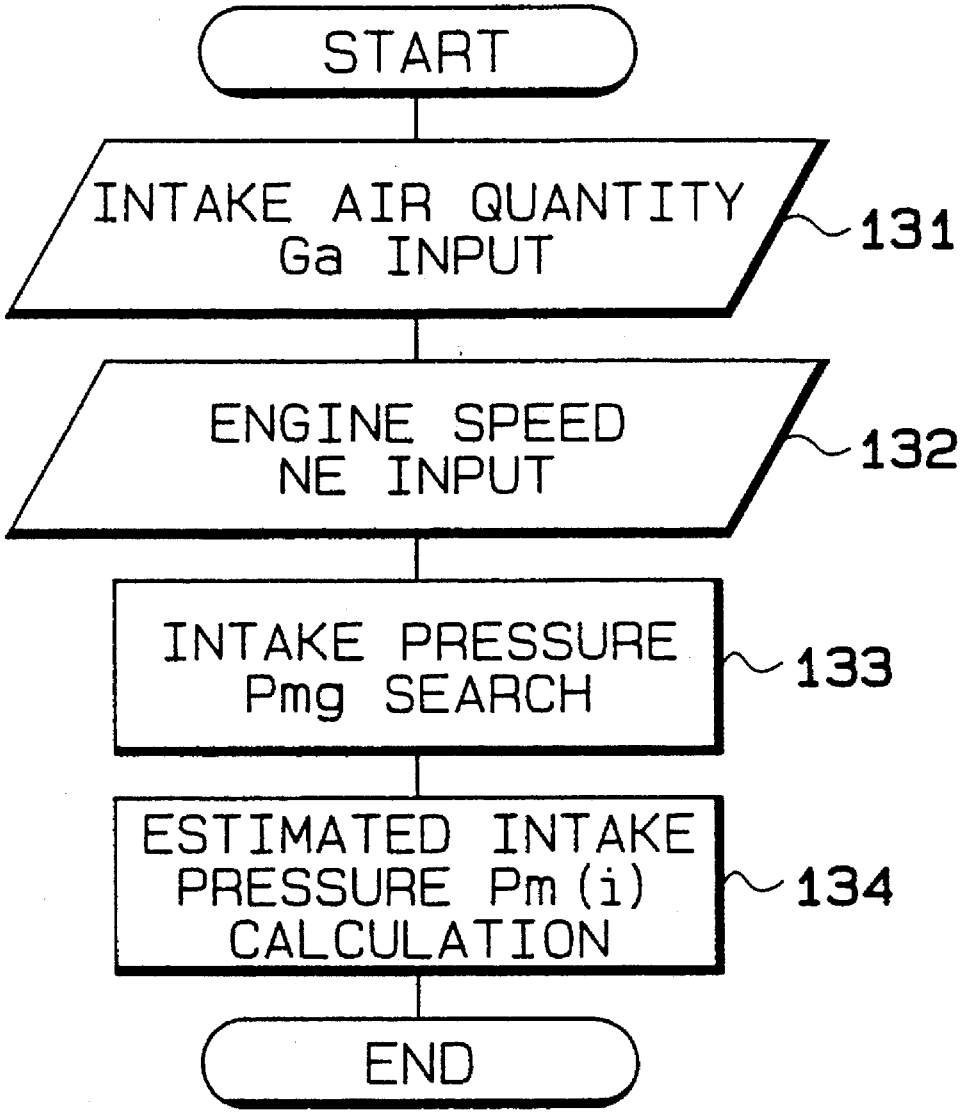
FIG. 9 is another flowchart showing the routine to be performed by the ECU 9 in the second embodiment.

Next, the flowchart for obtaining the estimated intake pressure $P_{m(i)}$ shown in FIG. 9 is explained. This flowchart is performed for every predetermined crank angle, e.g., for every 360° CA.

When this routine is started, first, at Step 131, the intake air quantity Ga is input. At Step 132, the rotational speed of the engine NE is input. At Step 133, the intake pressure $P_{mg}$ is searched for by using the two-dimensional table of the intake air quantity Ga and the rotational speed of the engine NE shown in FIG. 7. Then, at Step 134, the intake pressure $P_{mg}$ searched for at Step 133 is smoothed with an integer N by using the following smoothing equation for considering the response delay of the intake pressure during transition period.

$$P_{m(i)}=\frac{P_{mg}+(n-1)\times P_{m(i-1)}}{n} \tag{10}$$

Wherein, n denotes the coefficient of smoothing, $P_{m(i)}$ denotes the latest estimated intake pressure, and $P_{m(i-1)}$ denotes the previous estimated intake pressure.

By processing the above steps, the intake pressure is obtained by using the intake air quantity Ga and the rotational speed of the engine NE instead of directly detecting the intake pressure $P_m$.

Figure 8:
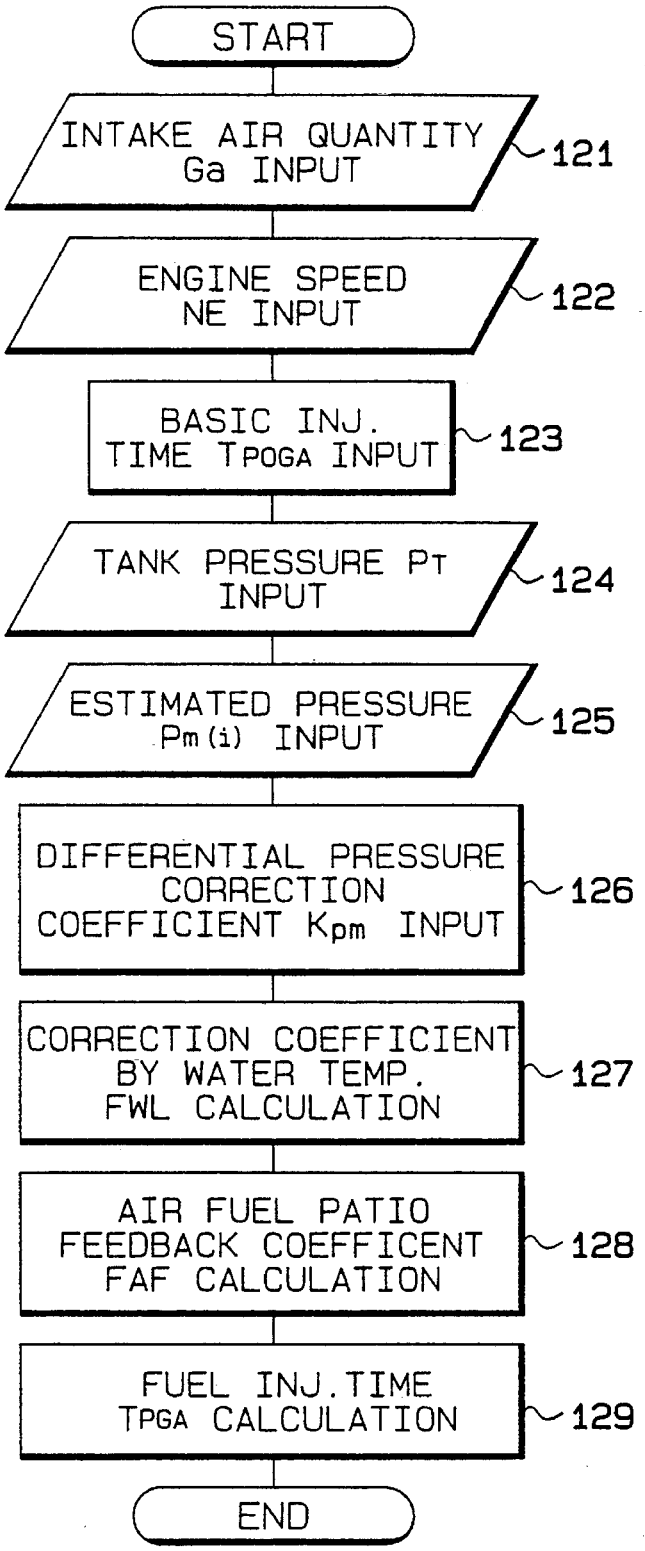
FIG. 8 is a flowchart showing the routine to be performed by the ECU 9 in the second embodiment.
Figure 10A:
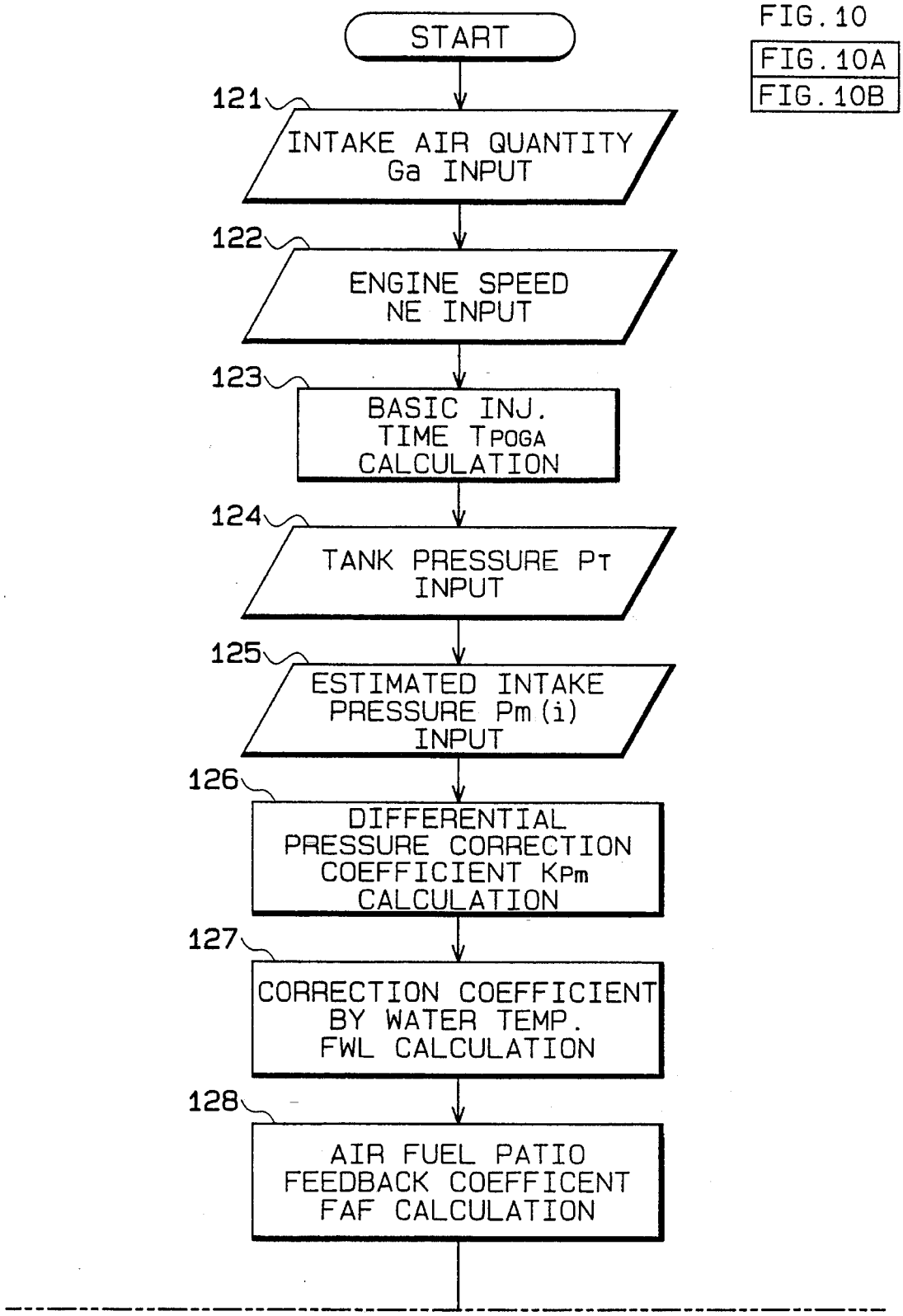
Figure 10B:
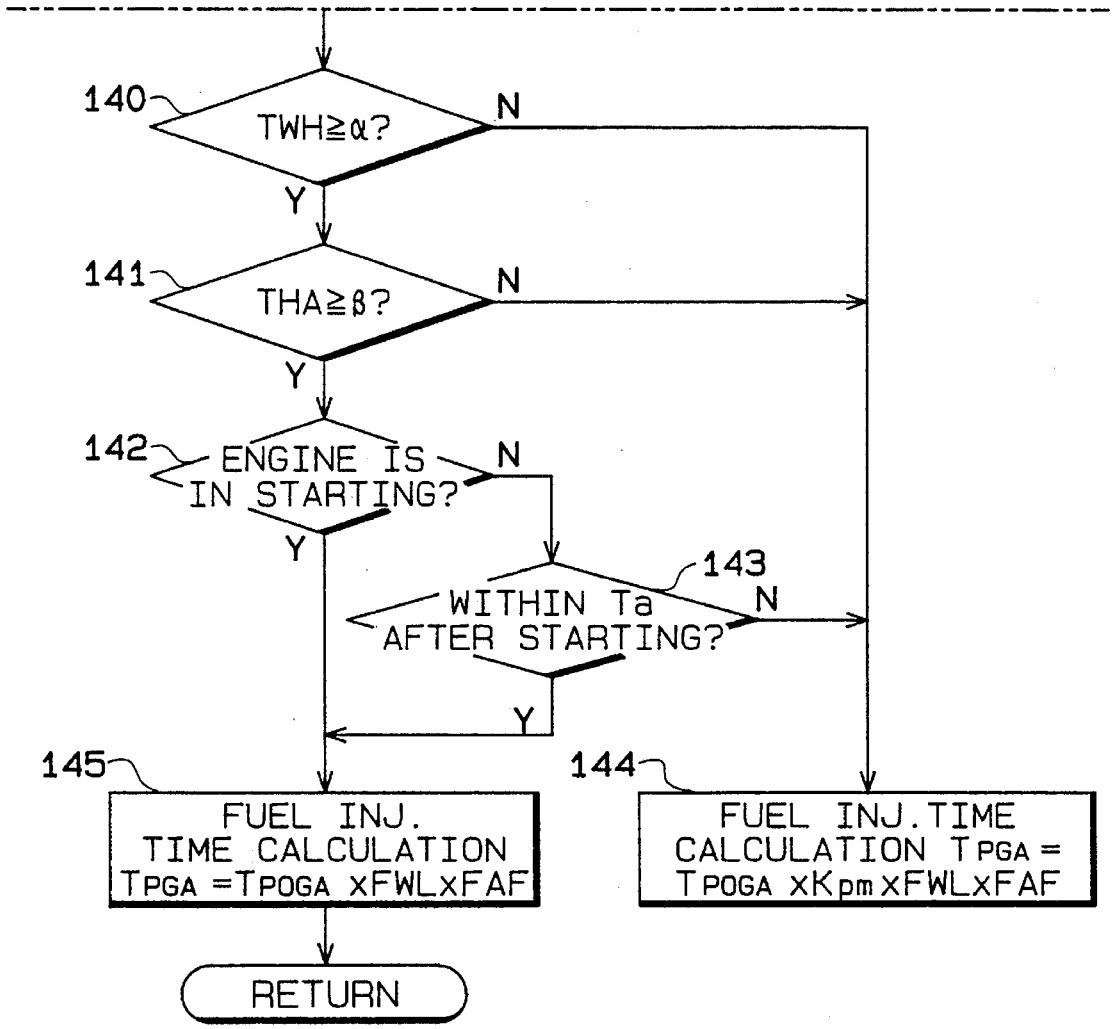

The process for performing the injection quantity control when the engine is in a high-temperature starting condition is explained with respect to the flowchart shown in FIGS. 10A and 10B in addition to the above control in the second embodiment. The steps in FIG. 10A that are identical to those in FIG. 8 are identified by the same reference numerals and a detailed discussion thereof is omitted.

After computing the coefficient of feedback FAF for the air fuel ratio feedback at Step 128, the ECU 9 judges at Steps 140 through 143 similarly to Steps 110 through 113 in FIG. 5 in the first embodiment, and then judges whether or not the engine is in a high-temperature starting condition. When the ECU 9 judges that the engine is in a high-temperature starting condition, the ECU 9 proceeds to Step 144, and computes the fuel injection time $T_{PGA}$ based on the pre-computed basic injection time $T_{POGA}$, the coefficient of differential pressure correction $K_{pm}$, the coefficient of water temperature correction FWL and the coefficient of air fuel ratio feedback FAF and by using Equation (8), and then terminates this routine.

On the other hand, if in the process for judgment at Steps 140 through 143, the ECU 9 judges that the engine is in a high-temperature starting condition, it then proceeds to Step 145.

Then, the ECU 9 computes the final fuel injection time $T_{PGA}$ based on the pre-computed basic injection time $T_{POGA}$, the coefficient of water temperature correction FWL and the coefficient of air fuel ratio feedback FAF and by using the following equation, and then temporarily terminates this routine.

$$T_P=T_{POGA}\times FWL\times FAF \tag{11}$$

When the ECU 9 judges that the engine is in high-temperature starting condition, the ECU 9 does not perform the correction with the coefficient of differential pressure correction $K_{TP}$ in computing the final fuel injection time $T_P$ in order to extend the valve open time, i.e., the fuel injection time, of the injection valve 4.

As described above, if the ECU 9 judges that the engine is in a high-temperature starting condition, the ECU 9 does not perform a correction with the coefficient of differential pressure correction $K_{TP}$ in computing the final fuel injection time $T_{PGA}$. For this reason, even if the engine is in a high-temperature starting condition in which the fuel injection quantity may easily sustain the shortage due to the influence of vapor contained in the fuel supplied into the injection valve 4, there is no possibility of such shortage in the fuel injection quantity in practical application. Accordingly, the fuel injection quantity shortage in a high-temperature starting is prevented, a good starting performance of engine is obtained, and the idling condition is prevented from being instable.

(THIRD EMBODIMENT)

In the above second embodiment, the estimated intake pressure $P_{m(i)}$ is computed by using the intake air quantity Ga detected by the air flow meter 29. When the engine is in an acceleration or deceleration condition, however, response delay is caused to the output of the air flow meter 29. Furthermore, in the operating range in which intake air pulsation is large e.g., in the full acceleration, an air quantity which is higher than the actual air quantity is output. In order to solve this problem, this embodiment precisely estimates the intake pressure even in such operating, as condition is explained below with reference to the third embodiment.

Figure 11:
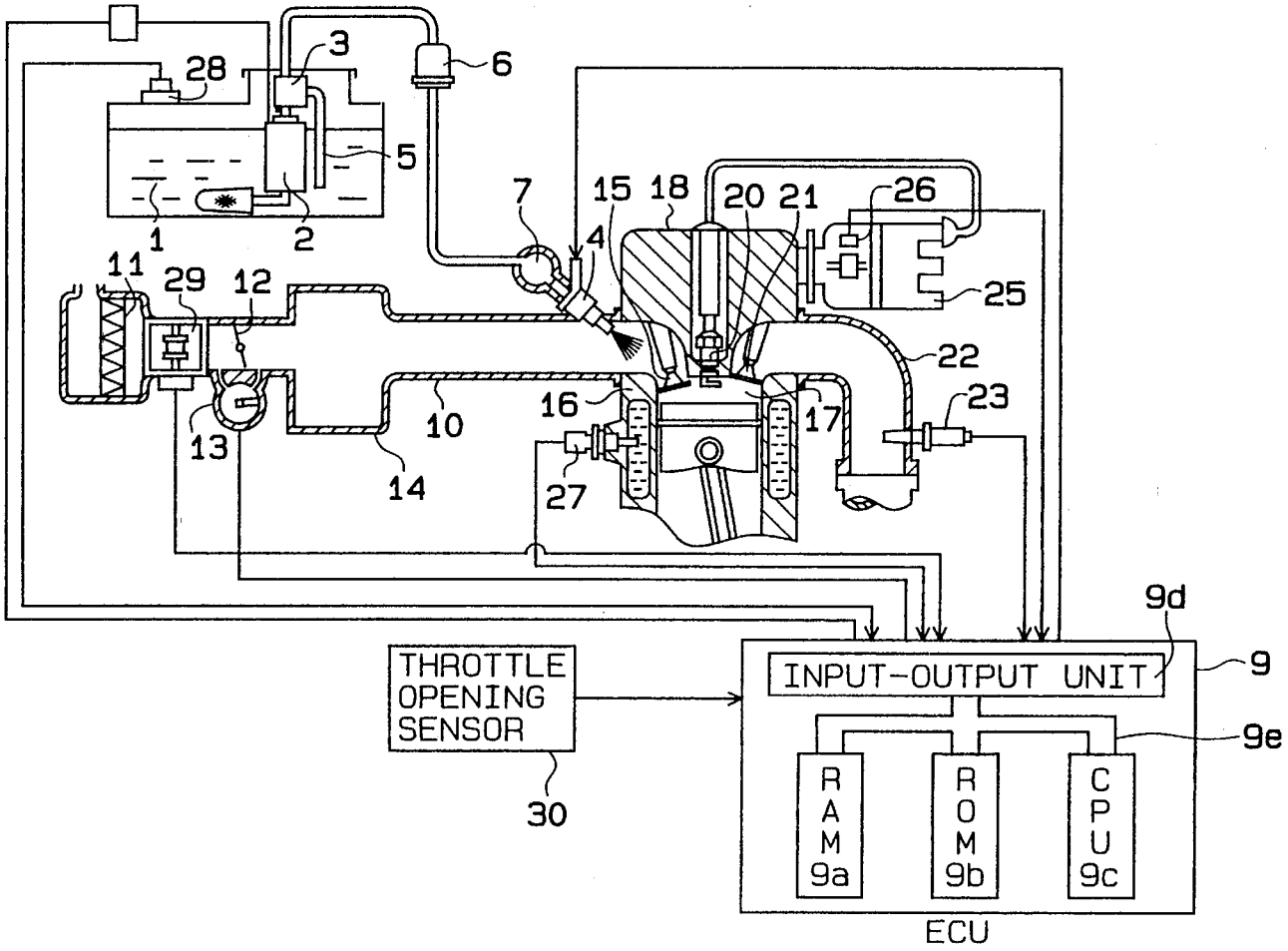
FIG. 11 is a view showing the configuration in the system of the third embodiment.

FIG. 11 shows the system configuration of the third embodiment. In the third embodiment, in addition to the configuration of the second embodiment, a throttle opening sensor 30 is disposed to send signals according to the opening degree of the throttle valve to the ECU 9.

Figure 12:
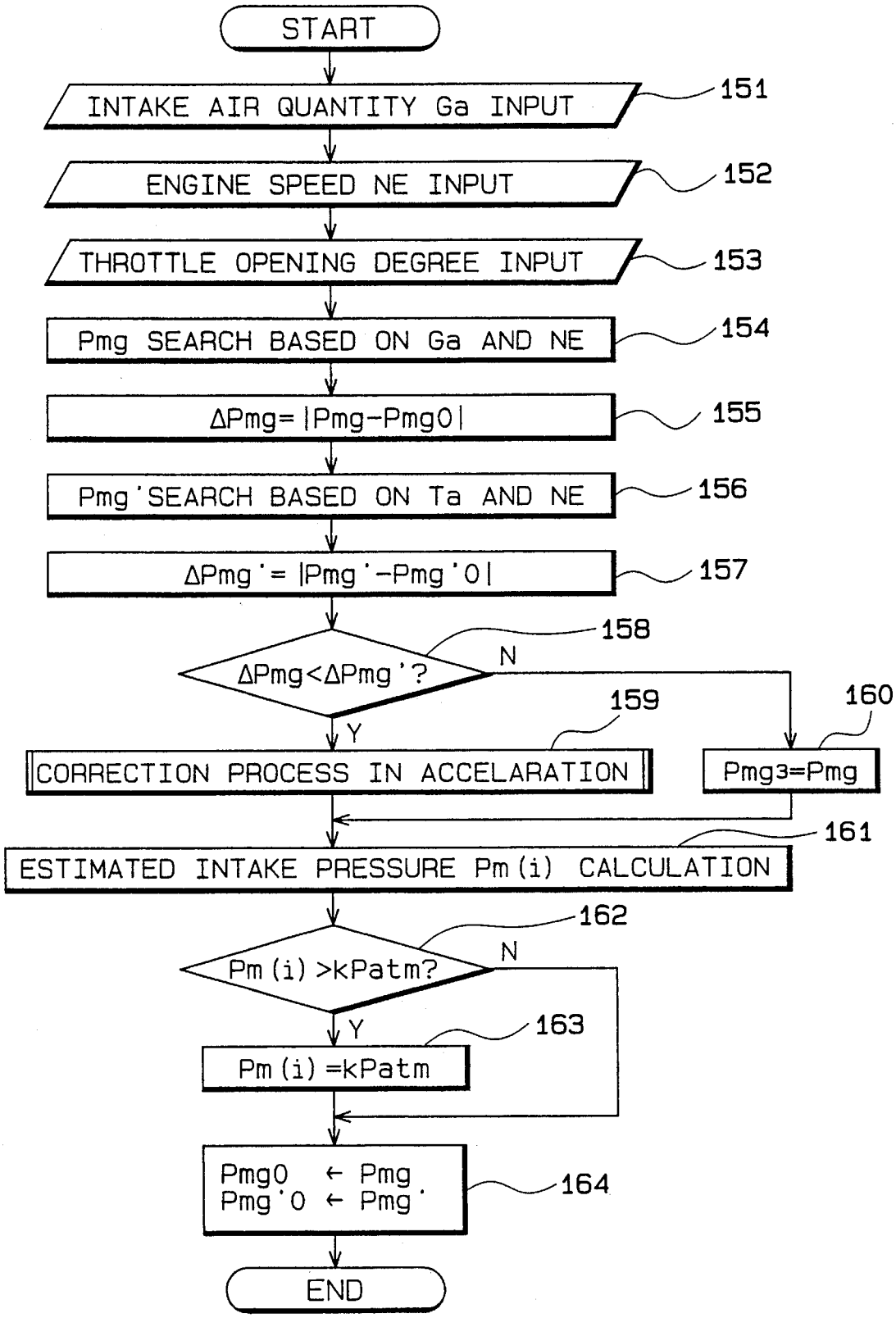
FIG. 12 is a flowcahrt showing the routine to be performed by the ECU 9 in the third embodiment.

FIG. 12 shows the flowchart of the process to be performed by the ECU 9 in the third embodiment. The process according to this flowchart is performed for every predetermined crank angle, e.g., for every 360° CA.

Figure 7:
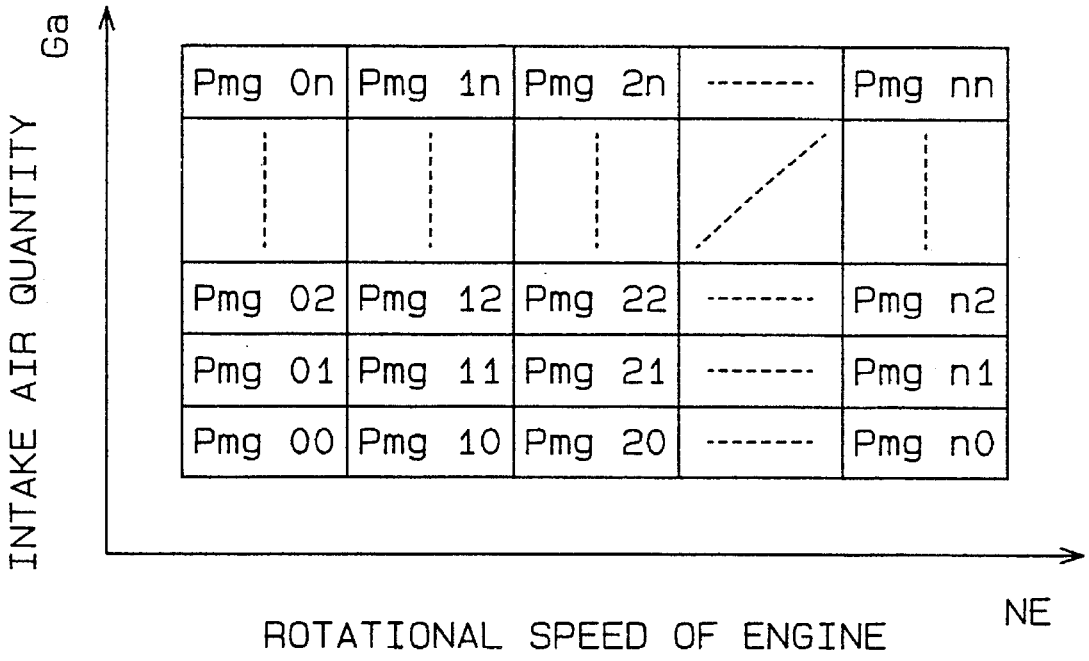
FIG. 7 is a table for obtaining the intake pressure from the intake air quantity and the rotational speed of the engine.

When this process is started, first, at Step 151, the intake air quantity Ga detected by the air flow meter 29 is input at Step 151. At Step 152, the rotational speed of the engine NE is input. At Step 153, the throttle opening degree Ta detected by the throttle opening sensor output is input. Then, at Step 154, the current searching intake pressure $P_{mg}$ is searched for by using the two-dimensional table prepared based on the intake air quantity Ga and the rotational speed of the engine NE as shown in FIG. 7. At Step 155, the variation in searching intake pressure, $\Delta P_{mg}$ is computed by using the following equation:

$$\Delta P_{mg}=|P_{mg}-P_{mg0}| \tag{12}$$

wherein, $P_{mg0}$ denotes the searching intake pressure previously searched for by using the table shown in FIG. 7.

Figure 13:
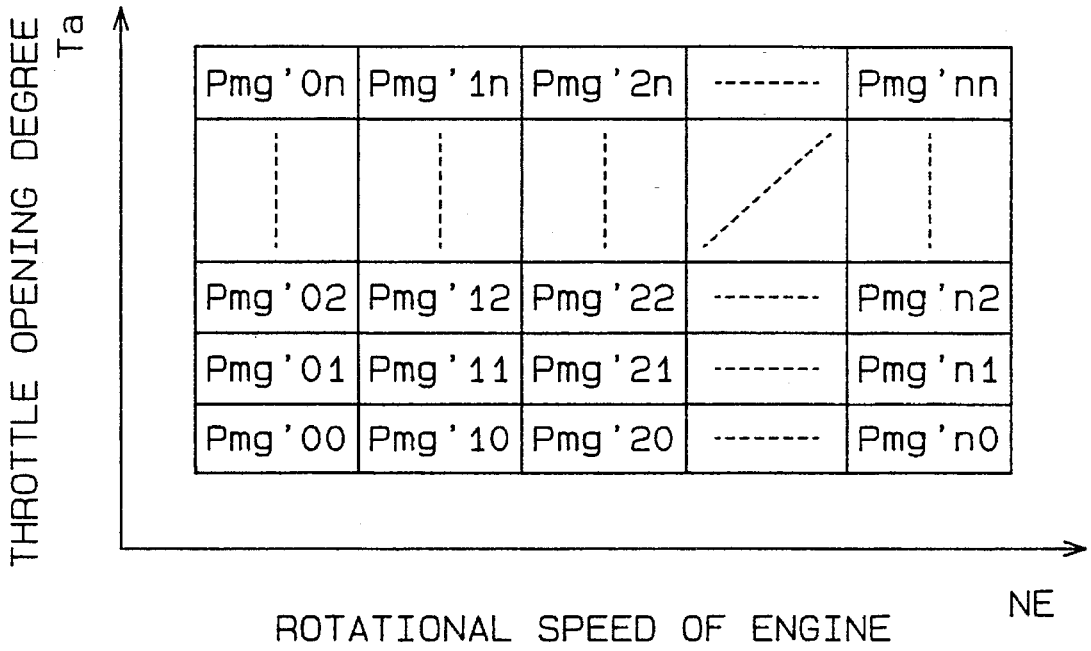
FIG. 13 is a table for obtaining the intake pressure from the throttle opening degree and the rotational speed of the engine.

At Step 156, the current searching intake manifold pressure $P_{mg'}$ is searched for by using the two-dimensional table prepared based on the throttle opening Ta and the rotational speed of the engine NE as shown in FIG. 13. Then, at Step 157, the variation in the second searching intake pressure, $\Delta P_{mg'}$ is computed by using the following equation:

$$\Delta P_{mg'}=|P_{mg'}-P_{mg'0}| \quad (13)$$

wherein, $P_{mg'0}$ denotes the searching intake pressure previously searched for by using the table shown in FIG. 11.

Figure 14:
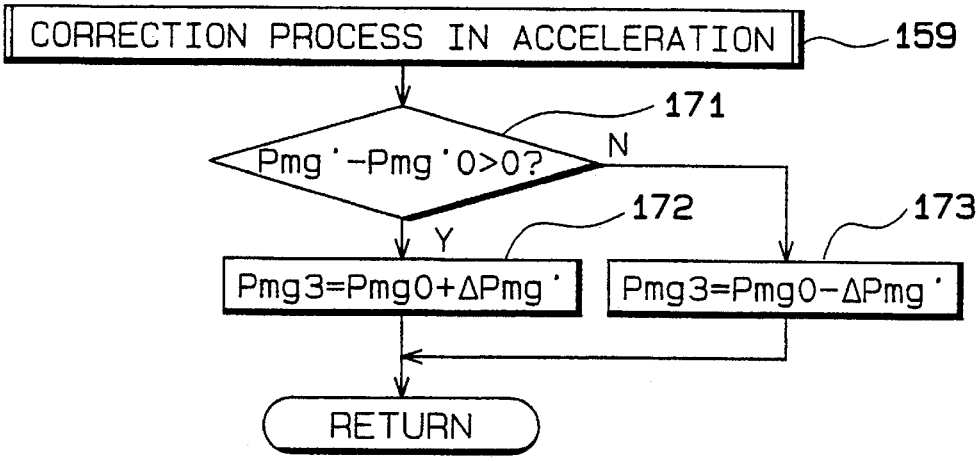
FIG. 14 is another flowchart showing the routine to be performed by the ECU 9 in the third embodiment.

At Step 158, the ECU 9 judges whether or not ΔPmg computed at Step 155 is smaller than $\Delta P_{mg'}$ computed at Step 157. When the judgment is positive, the ECU 9 proceeds to Step 159, and when the judgment is negative, proceeds to Step 160. At Step 160, the ECU judges whether or not the engine is in acceleration or a deceleration. If the judgment is positive, $P_{mg}$ is smaller than $P_{mg'}$, and proceeds to Step 159. At Step 159, an acceleration/deceleration correction is performed in accordance with the flowchart shown in FIG. 14, and the current searching intake pressure $P_{mg1}$ is computed. In the following paragraphs, the process for the acceleration/deceleration correction is explained with respect to FIG. 14.

When the correction for acceleration/deceleration is performed, the ECU 9 judges in Step 171 whether or not the following equation is satisfied:

$$P_{mg'}-P_{mg'}>0 \quad (14)$$

If the judgment is positive, the ECU 9 proceeds to Step 172, and if the judgment is negative, proceeds to Step 173. That is, when the current searching value $P_{mg'}$ is larger than the previous searching value $P_{mg'0}$, the ECU 9 judges the engine is in acceleration, and proceeds to Step 172, and when the current searching valve $P_{mg'}$ is equal to or smaller than the previous searching value $P_{mg'0}$, the ECU 9 judges the engine is in deceleration, and proceeds to Step 173. At Step 172, the searching intake pressure $P_{mg1}$ is computed by using the following equation:

$$P_{mg1}=P_{mg0}+\Delta P_{mg'} \quad (15)$$

On the other hand, at Step 173, the searching intake pressure $P_{mg1}$ is computed by using the following equation:

$$P_{mg1}=P_{mg0}-\Delta P_{mg'} \quad (16)$$

When the above procedure has been completed, the ECU 9 proceeds to Step 161.

Figure 20A:
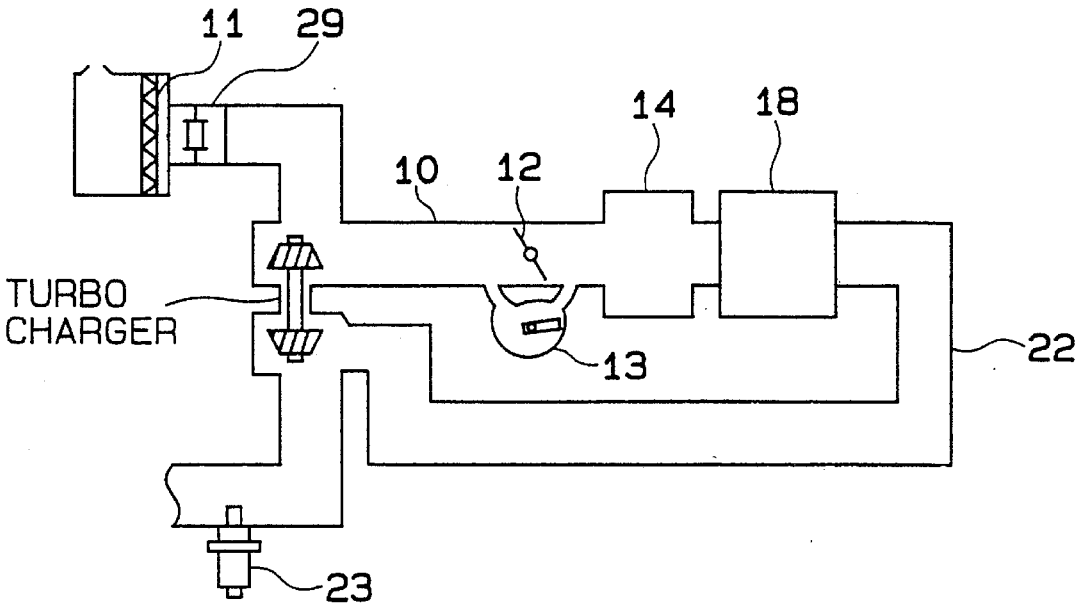
FIG. 20A is a schemetic cross-sectional view showing an embodiment in which the present invention is applied to an internal combustion engine equipped with a turbocharger.
Figure 20B:
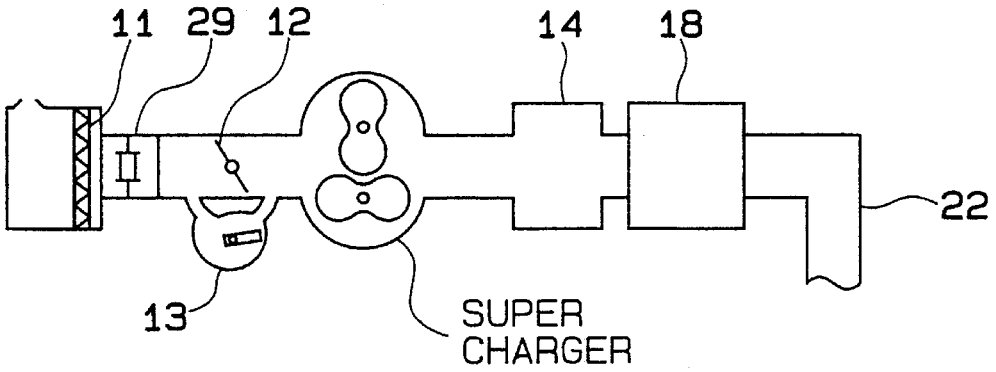
FIG. 20B is a schematic cross-sectional view showing an embodiment in which the present invention is applied to an internal combustion engine equipped with a supercharger.

When the judgment is negative at Step 158, the ECU 9 proceeds to Step 160, the searching intake pressure $P_{mg}$ is taken as the current searching intake pressure $P_{mg1}$ At Step 161, the current searching intake pressure $P_{mg1}$ computed as described above is smoothed by using Equation (8) to obtain the estimated intake pressure $P_{m(i)}$. As the next step, at Step 162, the ECU 9 judges whether or not this estimated intake pressure $P_{m(i)}$ is larger than the value corresponding to the atmospheric pressure, $KP_{atm}$ (or the value corresponding to the maximum supercharging pressure, if the present invention is applied to an engine provided with such a supercharger as shown in FIGS. 20A and 20B). When the judgment is positive, the ECU 9 proceeds to Step 163, $KP_{atm}$ is guarded such that the estimated intake pressure $P_{m(i)}$ is not beyond $KP_{atm}$, and the ECU 9 proceeds to Step 164. When the judgment is negative, the ECU 9 proceeds to Step 164 as it is. At Step 164, the currently detected $P_{mg}$ is taken as $P_{mg0}$ and $P_{mg'}$ as $P_{mg'0}$, and this process is terminated.

The intake pressure detected based on the throttle opening degree and the rotational speed of the engine has a comparatively good response to the variation in the intake pressure. In the third embodiment, therefore, the variation in the searching intake pressure $P_{mg'}$ detected based on the throttle opening degree and the rotational speed of the engine, $\Delta P_{mg'}$ is added to $P_{mg0}$ when the engine is in acceleration or subtracted from $P_{mg0}$ when the engine is in deceleration. By this process, the response delay in the air flow meter output during the time of the transition period is corrected.

The intake pressure $P_{mg'}$ detected based on the throttle opening degree and the rotational speed of the engine includes large errors. However, these errors get smaller by adding or subtracting the variation $\Delta P_{mg'}$. For this reason, in this embodiment, the variation in the intake pressure only when the engine is in acceleration/deceleration is computed based on the throttle opening degree and the rotational speed of the engine and correction is performed for such variation.

Furthermore, in the third embodiment, when the estimated intake pressure becomes higher than the pressure corresponding to the atmospheric pressure, the estimated intake pressure is taken as the pressure corresponding to the atmospheric pressure. By this process, when the intake air pulsation becomes intense due to the full opening of the throttle, the air flow meter outputs higher air quantity than the actual intake air quantity, and whereby, even if the estimated intake pressure becomes higher than the atmospheric pressure, the correction is properly performed.

Furthermore, in the above first, second and third embodiments, the fuel pressure (preset pressure of the pressure regulator 3) is maintained so as to be constant in proportion to the tank pressure. The fuel pressure, however, may be maintained so as to be constant in proportion to the atmospheric pressure by extending the ambient pressure introduction pipe 307 of the pressure regulator 3 disposed in the fuel tank 1 to the atmosphere outside of the fuel tank 1 or by disposing the pressure regulator 3 in the vicinity of the fuel tank 1.

(FOURTH EMBODIMENT)

In the above first, second and third embodiments, the atmospheric pressure is detected from the intake pressure when the starter is in the ON state or from the intake pressure estimated when the throttle is fully open. There is no need, however, to limit the atmospheric pressure detecting method to the above. Another method of detecting the atmospheric pressure is explained as the fourth embodiment.

Figure 15:
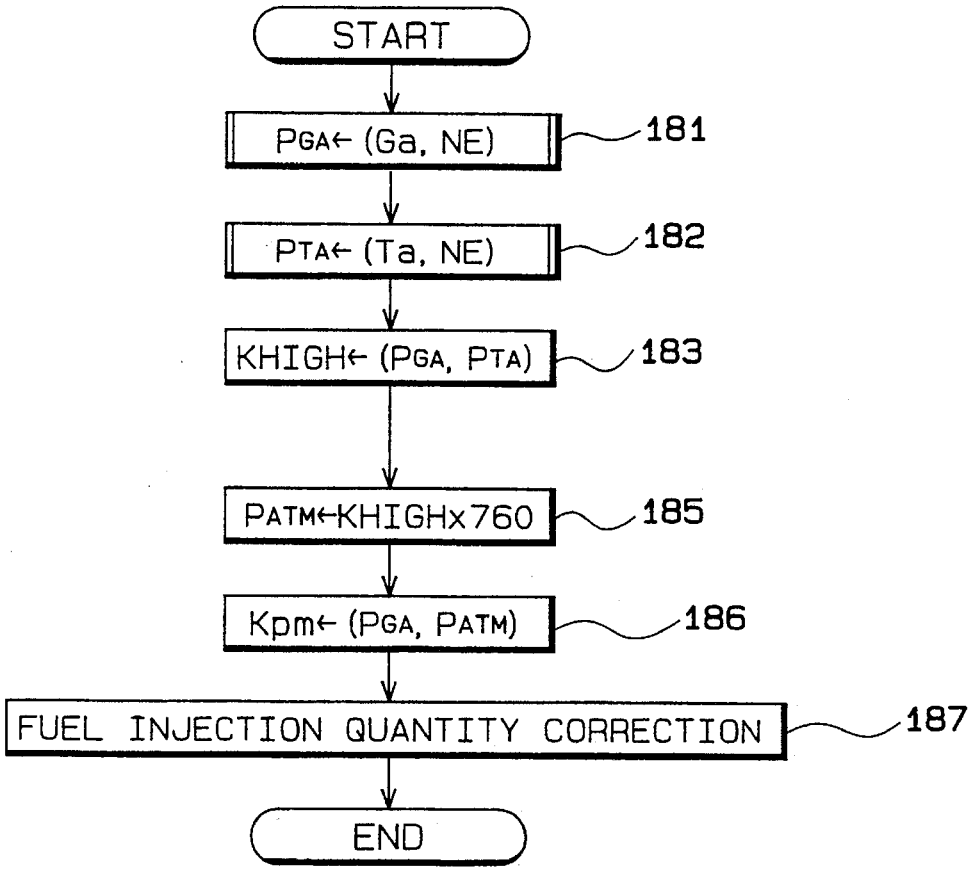
FIG. 15 is a flowchart showing the routine to be performed by the ECU 9 in the fourth embodiment.

FIG. 15 is a flowchart showing the process for the atmospheric pressure correction. The process of this flowchart is explained with respect to FIG. and is performed for every crank angle (e.g., 180° CA.).

Figure 16:
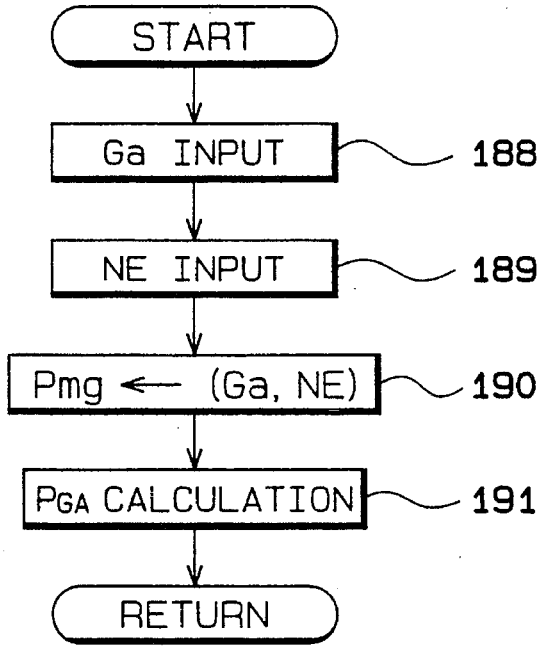
FIG. 16 is another flowchart showing the routine to be performed by the ECU 9 in the fourth embodiment.
Figure 17:
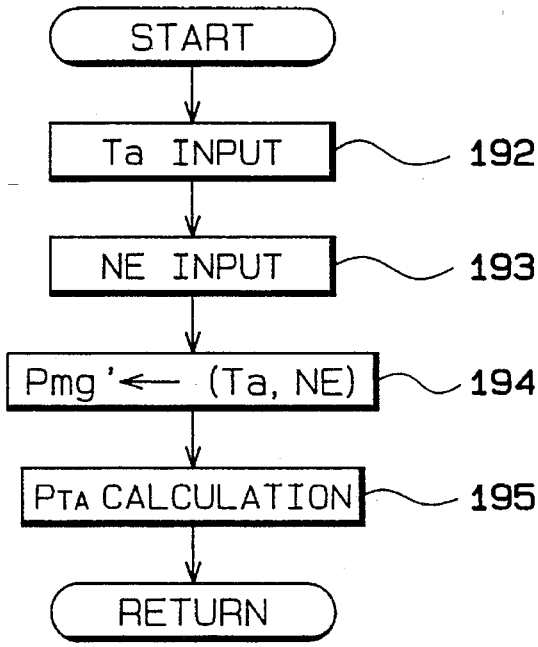
FIG. 17 is another flowchart showing the routine to be performed by the ECU 9 of the fourth embodiment.
Figure 18:
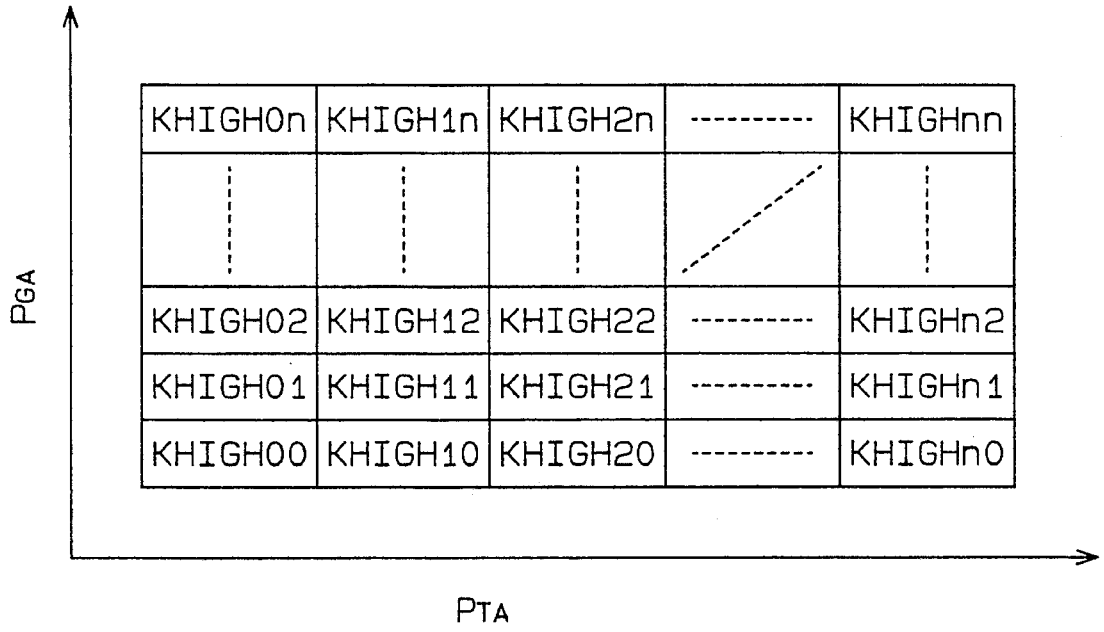
FIG. 18 is a table for obtaining the coefficient of high-degree correction based on the intake pressure obtained from the intake air quantity and the rotational speed of the engine and the intake pressure obtained from the throttle opening degree and the rotational speed of the engine.

When this process is started, at Step 181, the intake pressure $P_{GA}$ is detected based on the rotational speed of the engine NE and the intake air quantity Ga in accordance with the flowchart shown in FIG. 16. The process in FIG. 16 is described later. Then, at Step 182, the intake pressure PTA is detected based on the rotational speed of the engine NE and the throttle opening degree Ta and in accordance with the flowchart shown in FIG. 17. The process in FIG. 17 is also described later. At Step 183, the coefficient of height correction KHIGH is obtained from the two-dimensional table shown in FIG. 18. The two-dimensional table in FIG. 18 is prepared such that when PTA remains constant, the smaller the $P_{GA}$ is, the smaller the value of KHIGH is. Therefore, the intake pressure is not affected by the variation in the atmospheric pressure obtained based on the throttle opening degree and the rotational speed of the engine, however, it is affected by the variation in the atmospheric pressure obtained based on the intake air quantity and the rotational speed of the engine. That is, when the throttle opening degree and the rotational speed of the engine remain constant and the intake pressure is obtained based on the intake air quantity and the rotational speed of the engine, the lower the atmospheric pressure is, the lower the intake air quantity is, and therefore the lower the intake pressure is. At Step 185, the current atmospheric pressure $P_{ATM}$ is obtained by using the following equation:

$$P_{ATM} = KHIGHT \times 760 \quad (17)$$

Figure 19:
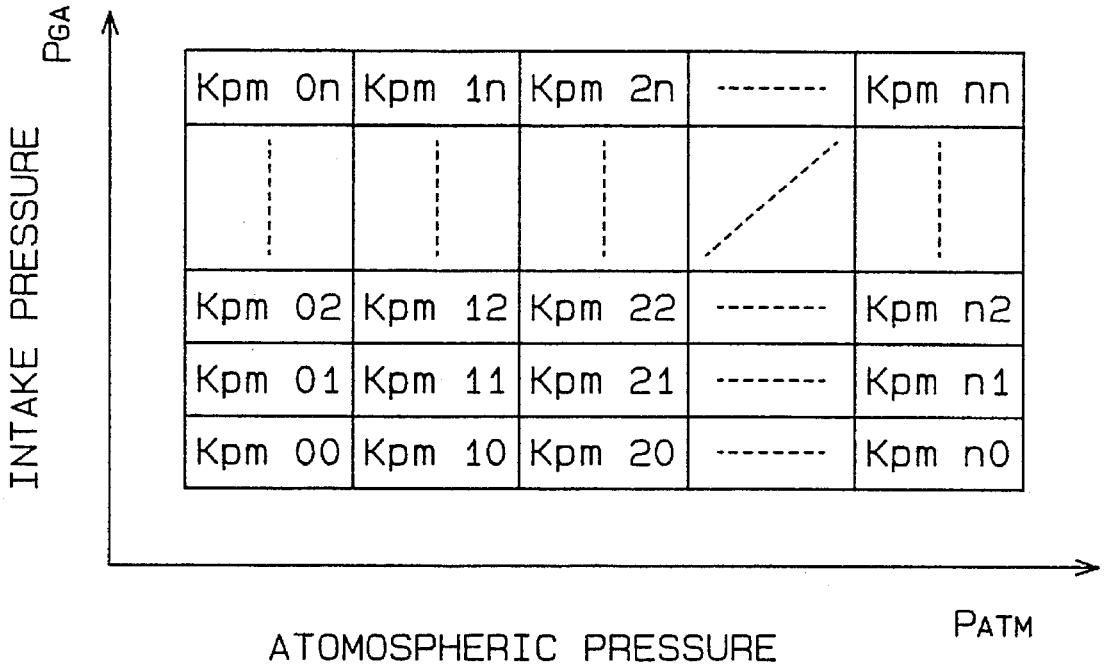
FIG. 19 is a table for obtaining the coefficient of intake pressure from the intake pressure and the atmospheric pressure.

At Step 186, the coefficient of fuel pressure correction Kpm is input from the two-dimensional table shown in FIG. 19) of this $P_{ATM}$ and the intake pressure $P_{GA}$ obtained at Step 181. Then, at Step 187, this coefficient of fuel pressure correction $K_{pm}$ is reflected on the fuel injection quantity correction.

Next, the process performed at Step 181 is explained with respect to the flowchart shown in FIG. 16.

First, at Step 188, the intake air quantity Ga is input. At Step 189, the rotational speed of the engine NE is input. At Step 190, the searching intake pressure Pmg is read from the table shown in FIG. 7. Then, the intake pressure Pmg is smoothed by using the following equation to obtain the intake pressure $P_{GA}$.

$$P_{GA} = \frac{(K_1 - 1) \times P_{GA(i-1)} + P_{mg}}{K_1} \quad (18)$$

Then, the process performed in Step 182 is described with respect to the flowchart shown in FIG. 17.

First, at Step 182, the throttle opening degree is input. Then, at Step 183, the rotational speed of the engine NE is input. In Step 184, the intake pressure is input from the table shown in FIG. 13. Then, the intake pressure $P_{mg}$, obtained from the table is smoothed by using the following equation to obtain the intake pressure $P_{TA}$.

$$P_{TA} = \frac{(K_2 - 1) \times P_{TA(i-1)} + P_{mg'}}{K_2} \quad (19)$$

As described above, in the fourth embodiment, the fuel injection quantity is precisely controlled by correcting the coefficient of fuel injection quantity correction according to the variation in the atmospheric pressure.

In each of the above embodiments, pressure correction is performed according to the synchronous injection for which the fuel is injected synchronously with the preset timing signals. The present invention, however, may also be applied to the asynchronous fuel injection which is not synchronous with the timing signals when the engine is starting accelerating, etc.

The injection quantity of the asynchronous injection is obtained from the one-dimensional table according to the variation in the intake pressure. This asynchronous injection quantity varies when the intake pressure varies, even when the valve open time of the injection valve remains constant. As described above, the correction for the fuel injection quantity according to the variation in the intake pressure is obtained by multiplying the asynchronous fuel injection quantity by the coefficient of intake pressure correction $K_{pm}$ computed by using Equation (6). Also, it may be applicable in the correction of the aysnchronous injection quantity that a value pre-computed is stored in the ROM **9*b*** as a one-dimensional table of the intake pressure, and the value of the then intake pressure is input therein to perform the correction.

(FIFTH EMBODIMENT)

The fifth embodiment of the present invention is explained with respect to FIGS. 21–25.

The gasoline engine of this embodiment is equipped with a fuel injection control system of a speed density type.

Figure 21:
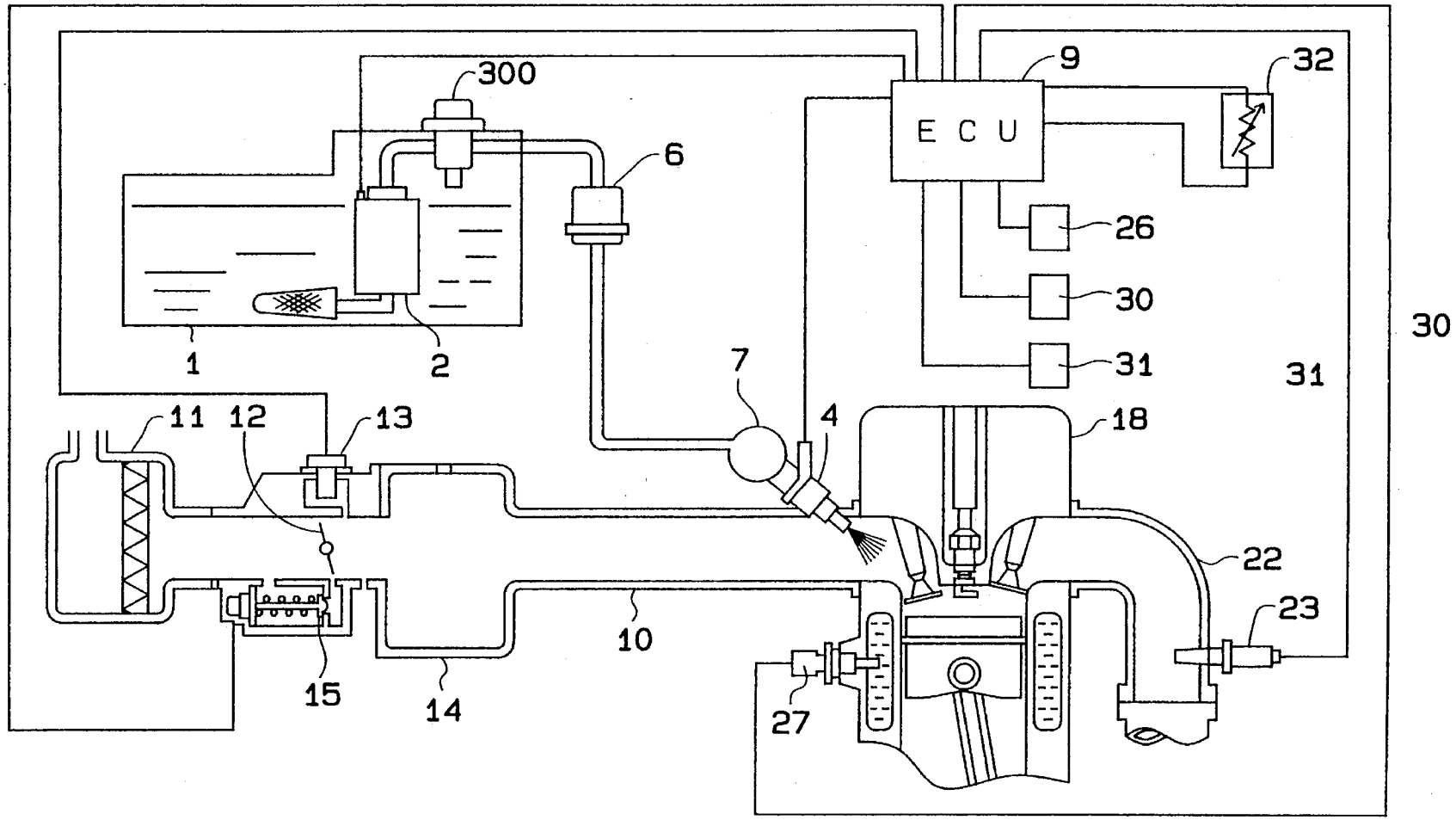
FIG. 21 is a view showing the configuration of the entire system of the fifth embodiment.

In FIG. 21, the fuel injection is controlled by an electronic control unit (ECU) 9 to which an intake pressure sensor 13, an air fuel ratio sensor 23, a cooling water temperature sensor 27, a rotational speed of the engine rotational speed sensor (or a rotational angle sensor) 26, a throttle opening sensor 30, an air fuel ratio manual regulator 35, a starter switch 31, etc. are connected.

Figure 22:
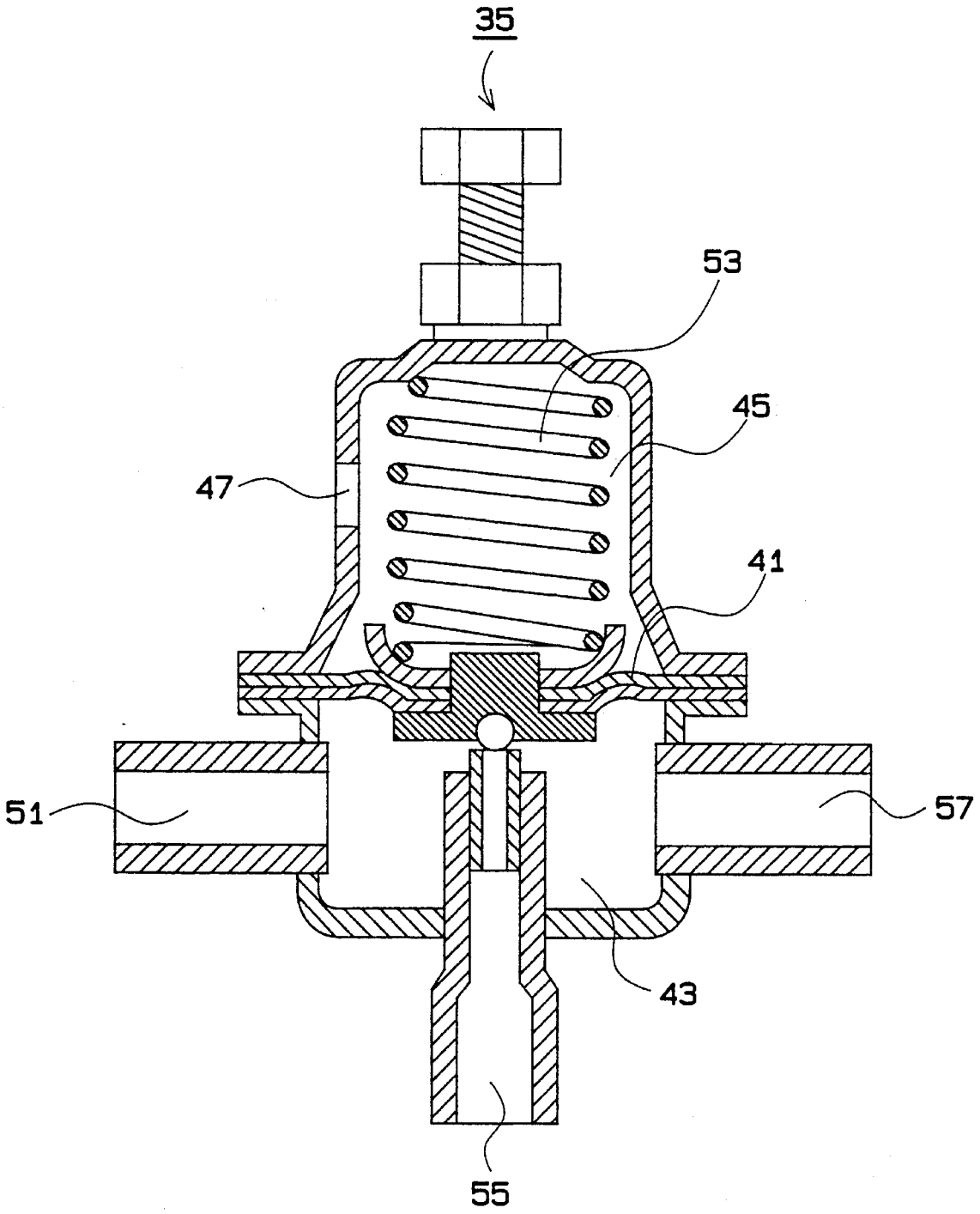
FIG. 22 is a cross-sectional view showing the structure of the pressure regulator shown in FIG. 21.

As shown in FIG. 22, a pressure regulator 3 is provided with a pressure regulation chamber 43 on one side of a diaphragm 41 and a backpressure chamber 45 at the other side thereof. The backpressure chamber 45 is open to the atmosphere through an open-to-atmosphere port 47, i.e., the pressure regulator 3 is of an open-to-atmosphere type. This pressure regulator 3 is operated such that when the pressure of the fuel introduced into the pressure regulation chamber 43 through a fuel inflow port 51 is lower than the predetermined pressure preset by the spring force of a compression coil spring 53, the return port 55 remains in the valve closed state, and when the pressure of the fuel in the pressure regulation chamber 43 is higher than the predetermined pressure preset by the spring force of a compression coil spring 53, the return port 55 turns to the valve opened state. When the return port 55 is in the valve open state, part of the fuel flowing into the pressure regulation chamber 43 from the fuel inflow port 51 is returned to a fuel tank 1, whereby the pressure of the fuel to be supplied into an injection valve 4 is regulated to a pressure level almost equivalent to the preset pressure of the pressure regulator 3, and the fuel, the pressure of which is regulated to the preset pressure, is supplied from the fuel outflow port 57 into a delivery pipe 7.

As this pressure regulator 3 is an open-to-atmosphere type with the backpressure chamber 47 open to the atmosphere, the fuel pressure regulation is subject to the effect of the atmospheric pressure, lowering the valve opening pressure of the return port 55 when the atmospheric pressure falls. Accordingly, the absolute pressure of the fuel to be supplied to the injection valve 4 falls as the atmospheric pressure falls. On the other hand, the pressure regulator 3 regulates the fuel pressure according to the atmospheric pressure, the lower the intake pressure in the intake manifold 10 is (the higher the negative pressure is), the higher the fuel delivery quantity per unit time is, when the injection valve 4 is in the open position.

Figure 23:
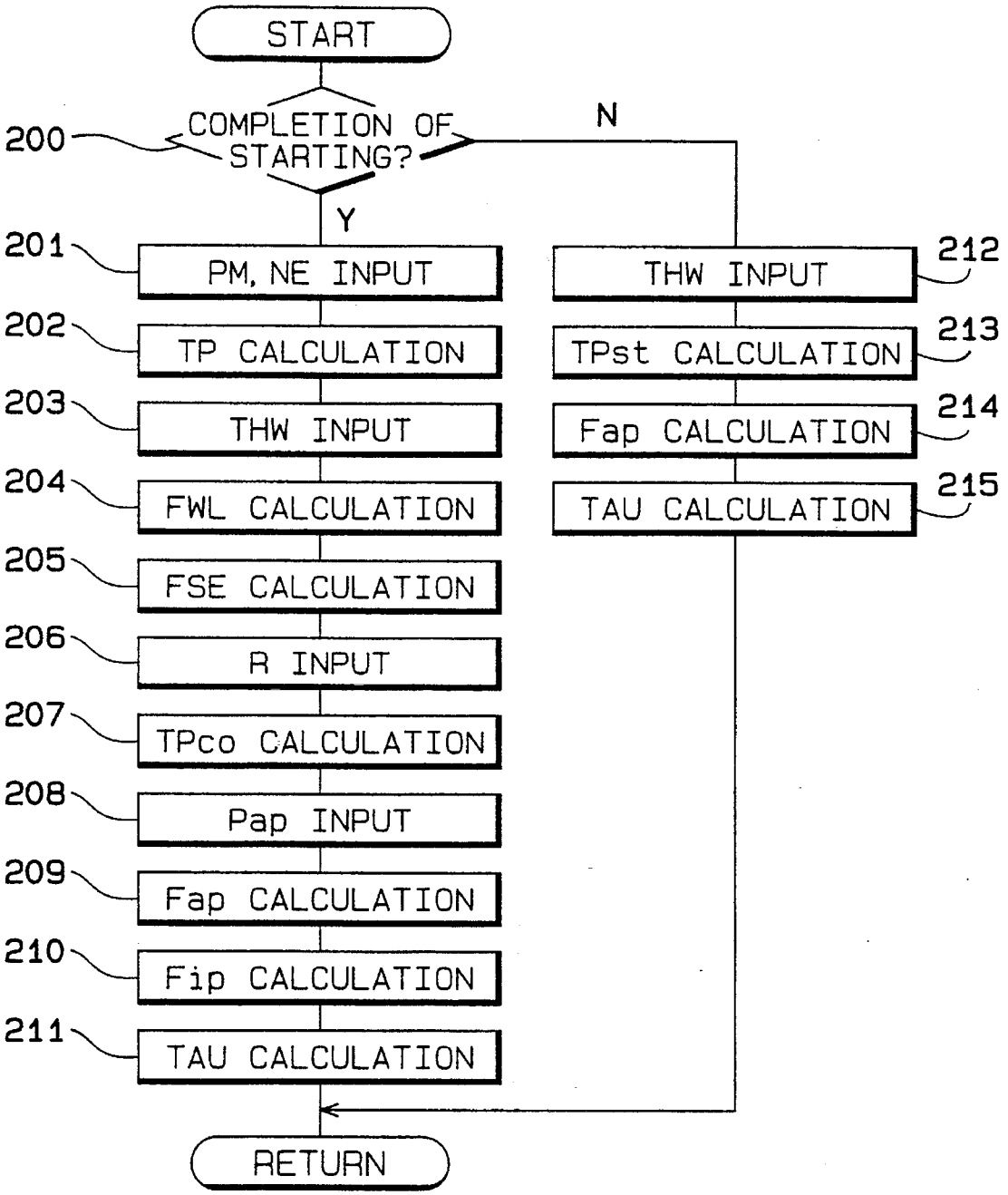
FIG. 23 is a flowchart for the fuel injection control in the fifth embodiment.

In the fifth embodiment, the process of the fuel injection control is performed by the ECU 9 as shown in FIG. 23.

In this process, first, at Step 200, the state of the starter switch 31 and the rotational speed of the engine NE are input, and the ECU 9 judges whether or not the starting has been completed. After the starter switch 31 has been turned ON and the rotational speed of the engine NE has reached 500 rpm or more, the starting is judged to have been completed. When the starting has been completed, the intake pressure PM detected by the intake pressure sensor 13 and the rotational speed of the engine NE detected by the rotational speed of the engine sensor 26 are input in Step 201. Then, in Step 202, the basic injection time $T_P$ is computed with reference to the two-dimensional table with the intake pressure PM and the rotational speed of the engine NE treated as parameters. This two-dimensional table shows the results of the bench test performed in advance under the standard atmospheric pressure of 1 hPa and stored in the ROM in the ECU 9.

Then, at Steps 203 and 204, the cooling water temperature detector THW detected by the cooling water temperature 27 is input and the coefficient of water temperature correction FWL is computed. On the other hand, at Step 205, the coefficient of increment correction after starting FSE is also computed using the cooling water temperature THW as a parameter. Furthermore, at Step 206, the register preset value R of the air fuel ratio manual regulator 35 is input. At Step 207, the CO regulation and injection time $T_{PCO}$ is computed.

At Step 208, the atmospheric pressure $P_{ap}$ is input, and the coefficient of atmospheric pressure correction $F_{ap}$ is computed using the following equation:

$$F_{ap} = \left\{ \frac{(P_{pr} - (P_{ap} - P_{at})}{P_{pr}} \right\}^{1/2} \tag{20}$$

wherein, $P_{pr}$ denotes the preset pressure of the pressure regulator 3, and $P_{at}$ denotes the standard atmospheric pressure.

Figure 24:
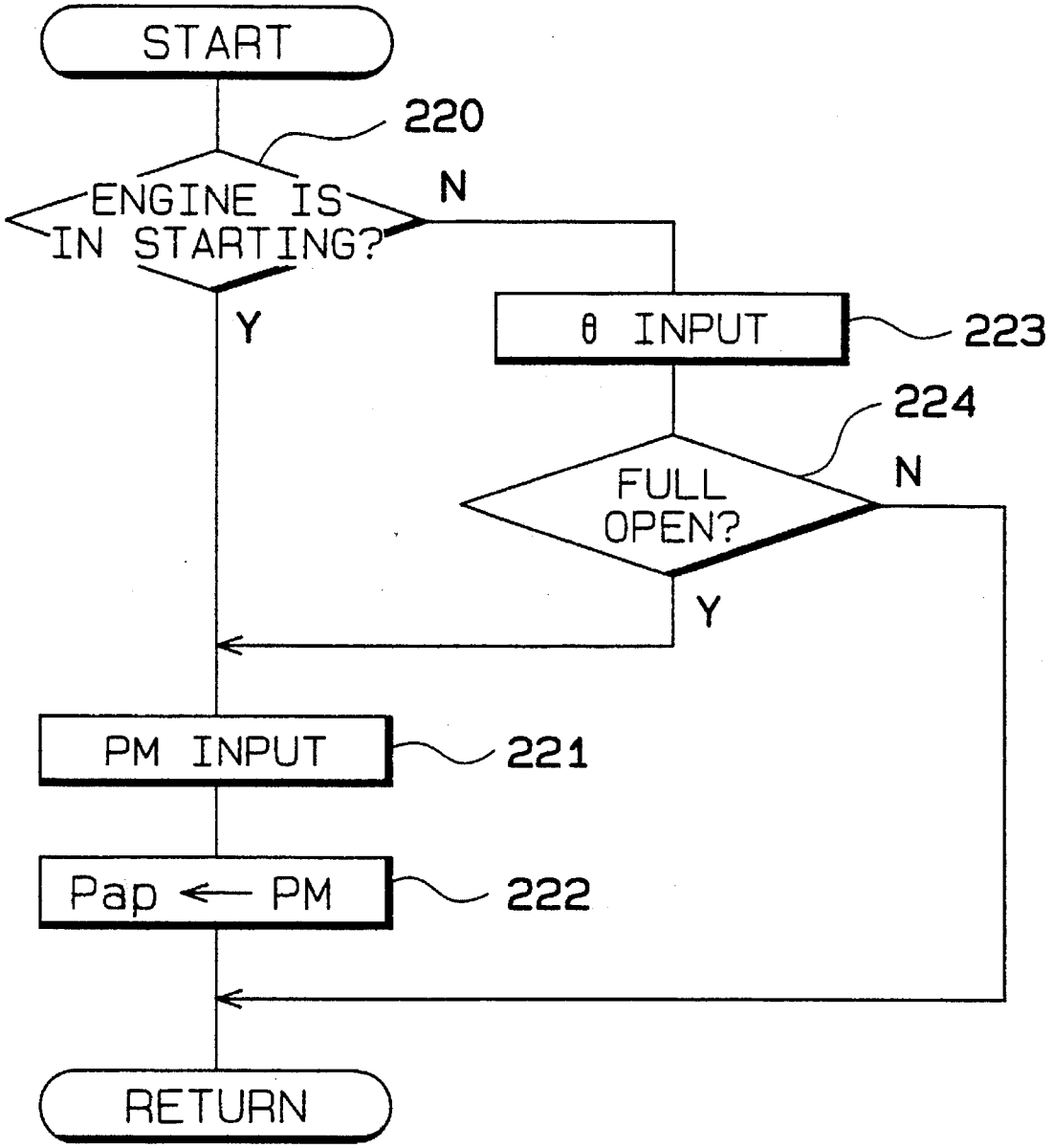
FIG. 24 is a flowchart for the measurement of the atmospheric pressure.

The atmospheric pressure $P_{ap}$ is measured as described below, and stored in the RAM in the ECU 9. As shown in FIG. 24, at Step 220, when the engine is in a starting condition, the detected value of the intake air sensor, PM, is input, and at Step 222, this value is stored in the RAM as the atmospheric pressure Pap. At Step 220, when the engine is not in a starting condition, the detected value of the throttle opening sensor 30, θ, is input at Step 223, and the ECU 9 judges whether or not the throttle is fully open at Step 224. When the throttle is fully opening, the ECU 9 proceeds to Step 221, and when the throttle is not fully open, the process is terminated. In this way, the atmospheric pressure $P_{ap}$ is measured by using the intake air sensor 13 and by rewriting the value when the operation is in such a condition that the intake pressure is equal to the atmospheric pressure.

Referring back to FIG. 23, when the coefficient of atmospheric pressure correction Fap is computed at Step 209, the coefficient of intake pressure correction $F_{ip}$ is computed by using the following equation:

$$F_{ip} = \left( \frac{P_{pr} - P_{ip}}{P_{pr}} \right)^{1/2} \tag{21}$$

wherein, the negative intake pressure $P_{ip}$ is equal to ($P_{at}$–PM). This is because $F_{ip}$ is the coefficient of the intake air correction under the standard atmospheric pressure, and under a pressure other than the atmospheric pressure, the injection quantity is corrected to be the injection quantity under the standard atmospheric pressure by using the coefficient of the atmospheric pressure correction $F_{ap}$, and then the correction is performed by using $F_{ip}$.

At Step 211, the fuel injection time TAU is computed by using the following equation:

$$TAU = T_p \times (FWL + FSE) \times Fap + T_{PCO} \times F_{ap} \times F_{ip} \tag{22}$$

On the other hand, when the judgment is formed that starting has not been completed at Step 200, the cooling water temperature THW is input at Step 212, and at Step 213, the starting injection time $TP_{st}$ is computed from the one-dimensional table, only the coefficient of the atmospheric pressure correction $F_{ap}$ is computed as the same way in Steps 208 and 209, and the fuel injection time TAU is computed by using the following equation:

$$TAU = TP_{st} \times F_{ap} \times F_{ip} \tag{23}$$

As described above, in the fifth embodiment, only the atmospheric pressure correction is performed for the basic injection time $T_P$ obtained with the intake pressure correction contained in the bench test, while both the atmospheric pressure correction and the intake pressure correction are performed for the CO regulation and injection time $T_{PCO}$ computed irrespective of the intake pressure.

The effects of the atmospheric pressure correction for all the items is explained below.

Figure 25:
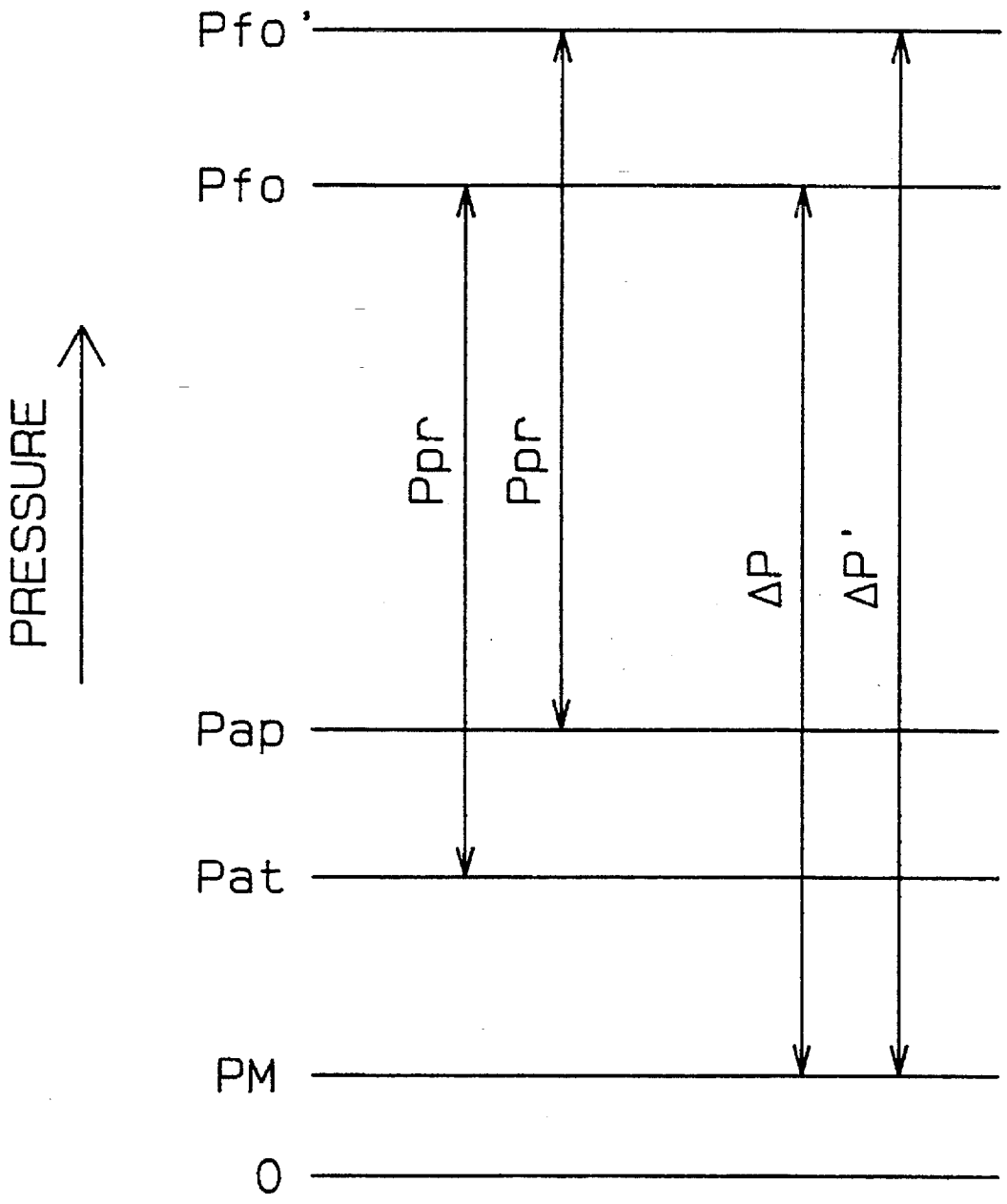
FIG. 25 is a diagram shwoing the effects of the fifth embodiment.

In this embodiment, as the preset pressure of the pressure regulator 3, $P_{pr}$, is preset according to the standard atmospheric pressure $P_{at}$, when the absolute fuel pressure PFO considered and the actual atmospheric pressure Pap is higher than the standard atmospheric pressure Pat, the absolute fuel pressure becomes higher accordingly as shown in FIG. 25 ($P_{fo} \rightarrow P_{fo'}$). Subsequently, the differential pressure of the fuel pressure $P_{fo'}$ from the intake pressure PM, ΔP' (=$P_{fo'}$–PM), is higher than the differential pressure under the standard atmospheric pressure $P_{at}$, P (=$P_{fo}$–PM). On the other hand, the basic injection time $T_p$ is computed at the bench test under the standard atmospheric pressure $P_{at}$, and the CO regulation and injection time $T_{PCO}$ is also obtained at the bench test on condition that the test is conducted under the standard atmospheric pressure $P_{at}$. Therefore, unless some atmospheric pressure correction is made, the fuel will be injected at a slightly higher quantity. However, when Equation (20) is used and Pap is equal to $P_{at}$, $F_{ap}$ is equal to 1, and when $P_{ap}$ is larger than $P_{at}$, $F_{ap}$ is smaller than 1, and when Pap is smaller than $P_{at}$, $F_{ap}$ is larger than 1. As a result, the error in the fuel injection quantity due to the deviation in the atmospheric pressure is eliminated. As a result, the fuel injection time TAU is corrected so as to be longer for driving at high altitudes. As a result, a horsepower shortage due to a low fuel injection quantity is prevented.

The effects of performing the intake pressure correction according to the CO regulation and injection time TPCO are as follows.

The CO regulation and injection time $T_{PCO}$ is preprogrammed in the ECU 9 according to the output voltage of the air fuel ratio manual regulator 35, and set to only one value by the register based on the emission measurements when the engine is idling in the final manufacturing process in a factory. In other words, the CO regulation and injection time $T_{PCO}$ is set to make the fuel injection quantity constant based on the register value irrespective of the intake pressure. Accordingly, as the intake pressure PM falls (as the intake negative pressure $P_{ip}$ (=$P_{ap}$–PM) rises), the differential pressure between the fuel pressure $P_{fo}$ and the intake pressure PM becomes larger, and the fuel is injected at a higher injection quantity than should be for CO regulation. According to Equation (22), however, as the higher the intake negative pressure $P_{ip}$, the lower the coefficient of the intake pressure correction under the standard atmospheric pressure, $F_{ip}$, the error in the fuel injection quantity for air fuel ratio regulation due to the variation in the intake pressure is eliminated. As a result, the optimum CO regulation is performed for any operating condition.

On the other hand, as it is clear from Equation (23), the coefficient of intake pressure correction $F_{ip}$ is not multiplied as to the items related to the basic injection time $T_P$. As described previously, this is because the basic injection time $T_p$ is given by the bench test as the two-dimensional table with the intake pressure PM and the rotational speed of engine NE as parameters, and therefore the very value read from this table is already contains the intake pressure correction. On the contrary, the intake pressure correction is performed for the value input from the table, the intake pressure is dually corrected, thereby causing errors in the fuel injection quantity.

As described above, by employing the open-to-atmosphere type pressure regulator 3 of in this embodiment, the layout, piping, etc. of the pressure regulator 3 is simplified. Even when the intake pressure PM falls, as is the case with the engine in idling, a sufficiently high absolute fuel pressure is maintained without being affected thereby. Furthermore, the generation of vapor in the fuel passages is controlled, and rough idling and other troubles are prevented. Moreover, while such effects is maintained, the errors in the fuel injection quantity due to the open-to-atmosphere structure is eliminated, and the fuel injection is constantly achieved at the precise quantity.

In this embodiment, the coefficient of water temperature correction FWL and the coefficient of the increment correction after starting FSE are taken as examples of the coefficients of correction for use in the computation of the fuel injection time TAU. In addition, other coefficients, such as the coefficient of intake pressure correction, the coefficient of idling stabilization correction, the coefficient of acceleration/deceleration correction, the coefficient of power increment correction and the coefficient of high-temperature restarting correction, are incorporated into the equations for computing the fuel injection time TAU.

(SIXTH EMBODIMENT)

Next, the sixth embodiment is explained.

Figure 26:
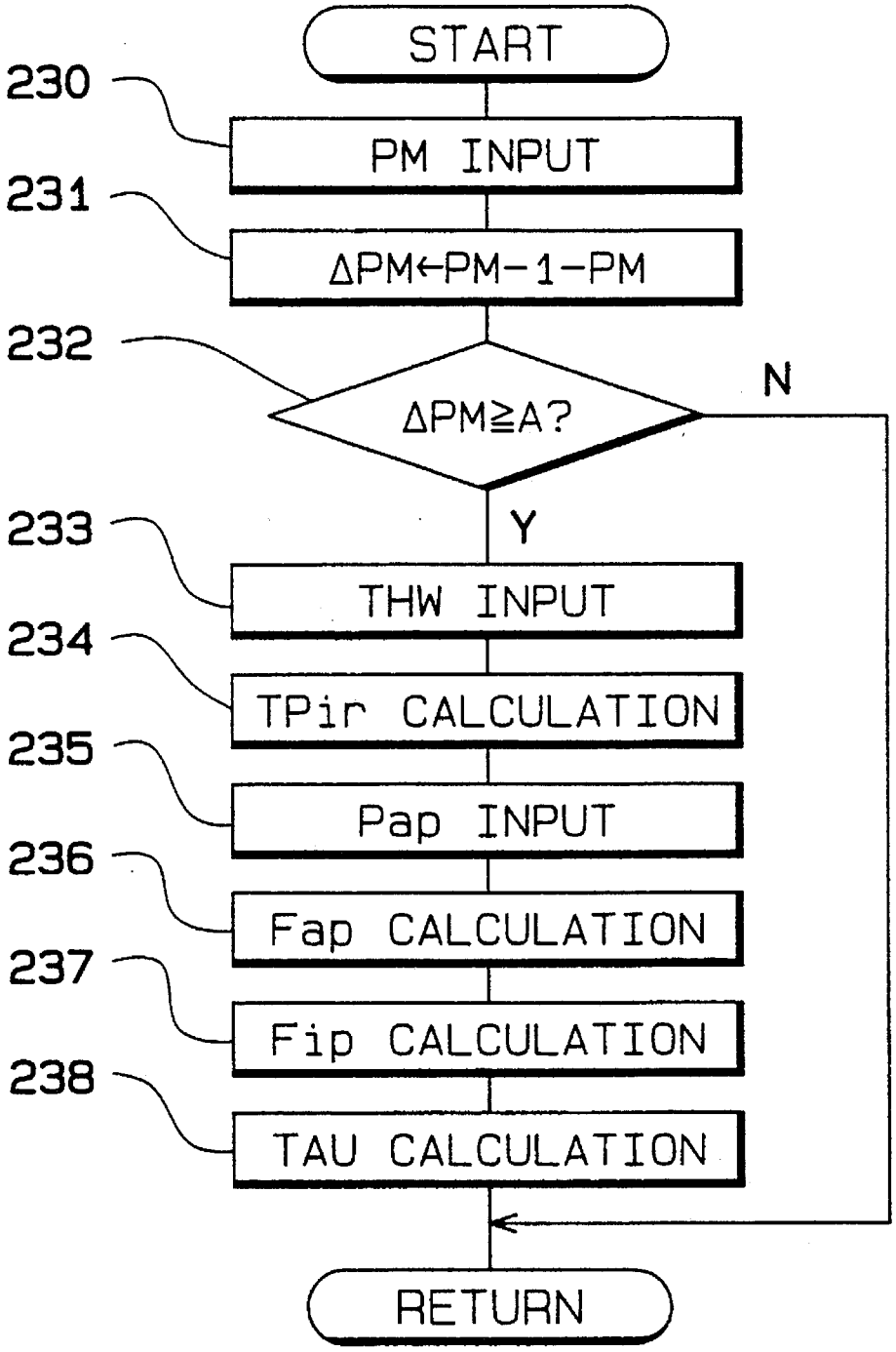
FIG. 26 is a flowchart for the fuel injection control in the fifth embodiment.

As with the fifth embodiment, the pressure regulator 3 is an open-to-atmosphere type. Thus, there is no difference in hardware between the two embodiments. In addition to the fuel injection control for the above regular operating condition, the sixth embodiment is characterized by including the fuel injection control for the transition period as described below. FIG. 26 shows a flowchart for this control process.

In this process, at Step 230, the intake pressure PM is input. At Step 231, the differential pressure PM from the previously read intake pressure $PM_{-1}$ is calculated. At Step 232, the ECU 9 judges whether or not the differential pressure PM is equal to or higher than the predetermined value A. When the differential pressure ΔPM is equal to or higher than the predetermined value A, cooling water temperature THW is input at Step 233, and the asynchronous injection time $TP_{ir}$ is obtained at Step 234. This asynchronous injection time $TP_{ir}$ is obtained based on the cooling water temperature THW and the differential pressure of the value of the intake pressure, ΔPM, irrespective of the value of the intake pressure PM itself.

Next, at Step 235, the atmospheric pressure $P_{ap}$ is input. At Step 236, the coefficient of atmospheric pressure correction $F_{ap}$ is obtained by using the above Equation (20). Furthermore, at Step 237, the coefficient of intake pressure correction Fip is obtained using Equation (21), and at Step 238, the fuel injection time TAU is obtained by using the following equation:

$$TAU=TP_{ir}\times F_{ap}\times F_{ip} \tag{24}$$

Accordingly, the asynchronous injection time $TP_{ir}$ is corrected based on the atmospheric pressure and the intake pressure in the sixth embodiment. As a result, the asynchronous injection is achieved at the precise fuel quantity, and accelerability, etc. is preferably achieved.

Although five and six embodiments of the present invention have been described herein, it should be apparent that the present invention may be embodied in many other forms without departing from the spirit or the scope of the invention.

Figure 27:
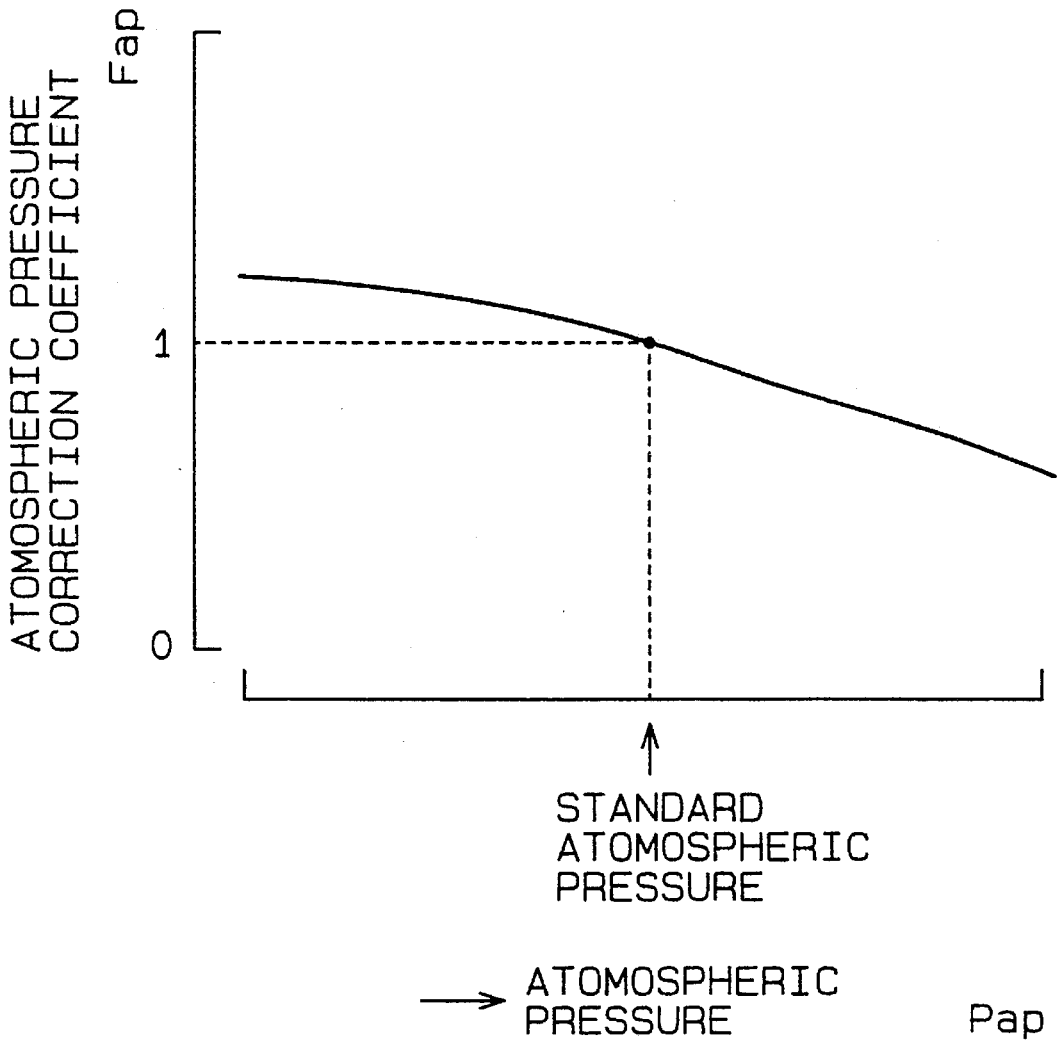
FIG. 27 is a one-dimensional table for obtaining the coefficient of atmospheric pressure correction of other embodiments.
Figure 28:
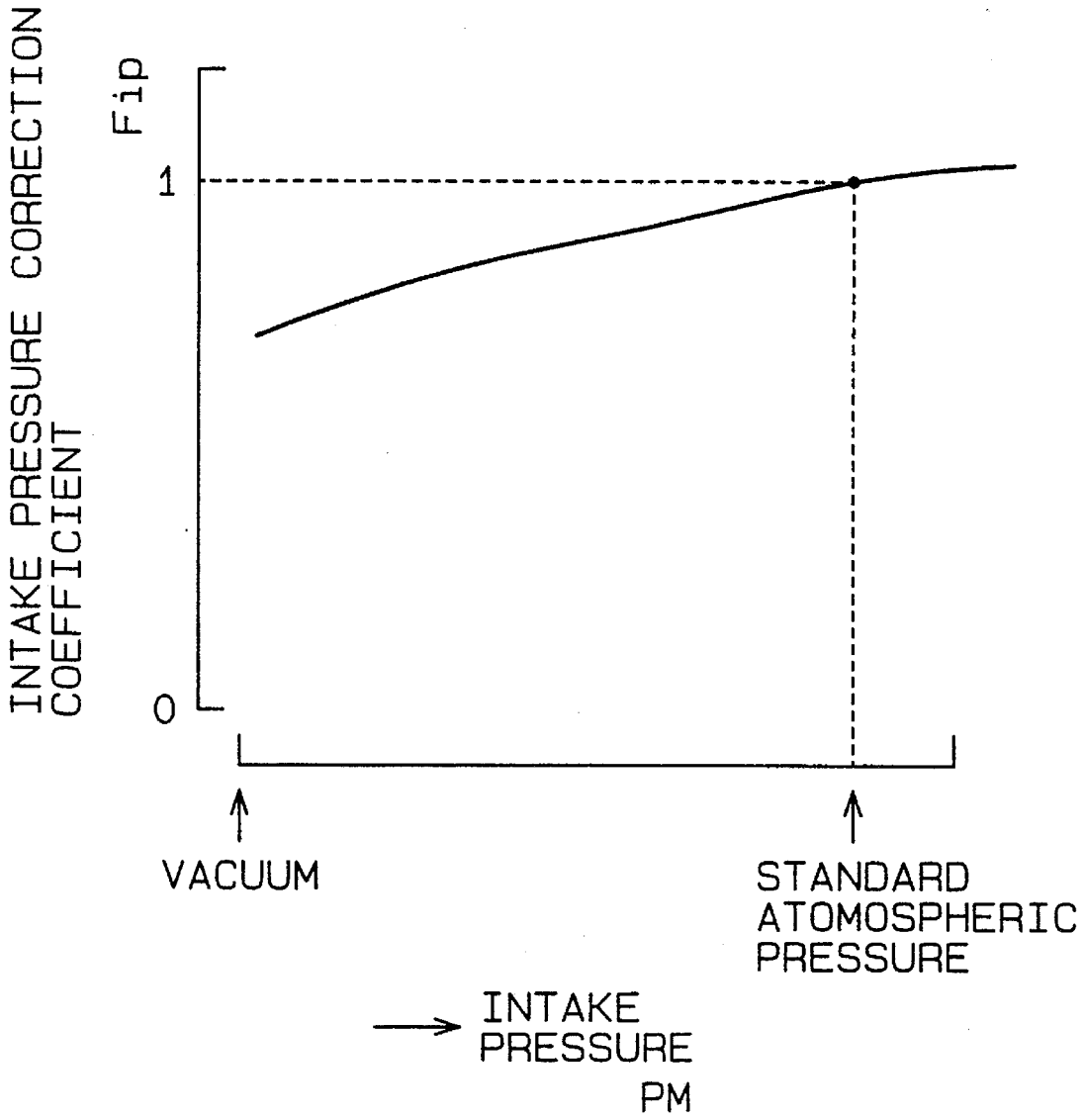
FIG. 28 is another one-dimensional table for obtaining the coefficient of atmospheric pressure correction of other embodiments.

For example, though the coefficients of correction $F_{ap}$ and $F_{ip}$ are obtained by using Equations (20) and (21) respectively, this may be difficult in some cases due to various problems with the ECU 9 (e.g., program size). In such cases, it may be applicable that the atmospheric pressure correction and the intake pressure correction are obtained by using such one-dimensional tables as shown in FIGS. 27 and 28 respectively, wherein only the values on some points are stored, and intermediate point values are obtained by interpolating considerations.

Furthermore, the atmospheric pressure correction is performed in the fifth and sixth embodiments. For those engines used for vehicles designed to be mainly driven in city streets such as light cars, there is no need to take into account the variation in the atmospheric pressure for high altitude driving. Therefore, only the intake pressure correction may be performed according to the CO regulation and injection time $T_{PCO}$ or the asynchronous injection time $TP_{ir}$.

Moreover, the atmospheric pressure Pap may be always detected by a dedicated atmospheric pressure sensor.

In addition to the corrections in the above embodiments, the correction according to the variation in the internal EGR quantity due to the variation in the atmospheric pressure may be applied to all the items. When higher precision control is demanded for the fuel injection quantity control, this control may be more preferable.

(SEVENTH EMBODIMENT)

Next, another embodiment estimating the intake pressure based on the intake air quantity and rotational speed of the engine is explained as the seventh embodiment.

Figures 29, 30:
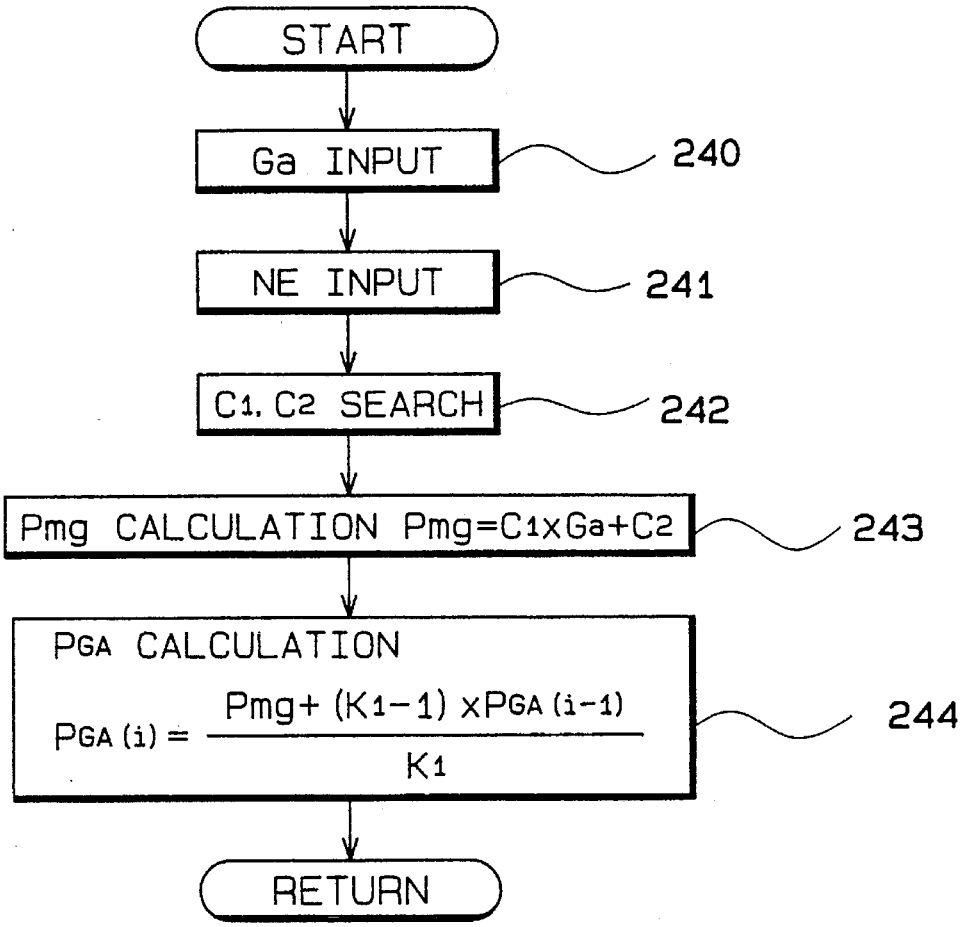
FIG. 29 is a flowchart showing the routine to be performed by the ECU 9 in the seventh embodiment.
FIG. 30 is a table for obtaining constants $C_1$ and $C_2$ for estimating the intake pressure in the seventh embodiment.

FIG. 29 is a flowchart showing the process for estimating the intake pressure of this embodiment. The embodiment is explained with respect to this flowchart as below. The process of this flowchart is performed for every crank angle (e.g., 360° CA.).

When this process is started, first, at Step 240, the intake air quantity Ga is input. Then, the rotational speed of the engine NE is input at Step 241, and constants $C_1$ and $C_2$ used for estimating the intake pressure Pmg in accordance with the table shown in FIG. 30 corresponding to the rotational speed of the engine NE input at Step 242 are read. The values of $C_1$ and $C_2$ are determined by taking into account the dynamic effect.

Then, the intake pressure $P_{mg}$ is estimated at Step 244 by using the following equation.

$$P_{mg}=C_1\times Ga\times C_2 \tag{25}$$

Furthermore, the intake pressure is accurately obtained by using the following equation.

$$P_{GA(i)}=\frac{P_{mg}+(k_1-1)\times P_{GA(i-1)}}{k_1} \tag{26}$$

Wherein, $k_1$ denotes a smoothing coefficient (e.g. $K_1$ is 8 in this embodiment), and $P_{GA(i-1)}$ denotes the previous estimated value.

As described above, in this embodiment, as the intake pressure is estimated by Equation (25), it is sufficient only to obtain the values of $C_1$ and $C_2$. As the values of $C_1$ and $C_2$ are searched for using a one-dimensional table of the rotational speed of the engine NE, the memory capacity of the device is reduced.

(EIGHTH EMBODIMENT)

Figure 31:
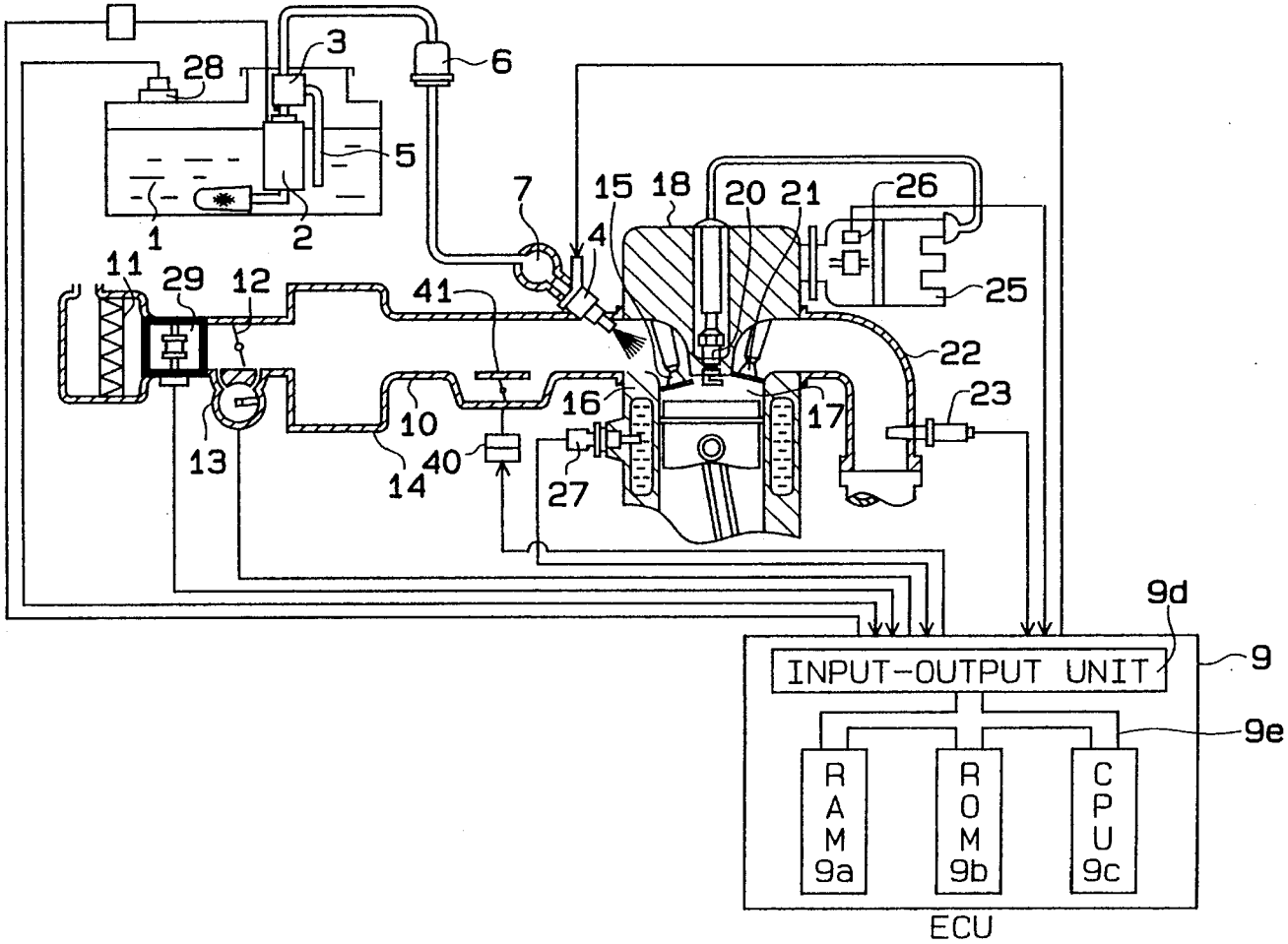
FIG. 31 is a view showing the configuration of the system of the eighth embodiment.

As the values of $C_1$ and $C_2$ are determined by taking into account the dynamic effect, this process is easily applied to, for example, the internal combustion engine equipped with variable intake control apparatus, for estimating the intake pressure. The embodiment in which the intake pressure estimating process in the seventh embodiment is applied to the internal combustion engine equipped with a variable intake control system is explained as an eighth embodiment of the present invention. FIG. 31 is a schematic configuration view in which a variable intake control apparatus is applied to the internal combustion engine shown in FIG. 6. In FIG. 31, the same components shown in FIG. 6 are indicated with same reference number, and these explanation is also omitted.

In this embodiment, an intake pipe 10 is divided into two intake pipes 10*a* and 10*b* downstream of the surge tank 14, and these pipes join at the upstream side of the fuel injection valve. Furthermore, a butterfly valve 41 is disposed in the intake pipe 10*b*. The butterfly valve 41 is operated to open or close by an actuator 40 in accordance with an operating signal from the ECU 9.

The butterfly valve 41 is operated, to close when the rotational speed of the engine is low, and to open when the rotational speed is high. By operating the butterfly valve 41 like this, a sufficient flow velocity in the intake pipe is obtained.

However, as the volume in the intake pipe varies as the butterfly valve 41 is operated the intake pressure should be estimated, respectively, when valve is open or closed. Accordingly, constants C1 and C2 used for estimating the intake pressure should be determined by respective cases.

The process for estimating the intake pressure according to the respective cases that the butterfly valve 41 is open or closed is explained as below with respect to the flowchart shown in 32. The process of this flowchart is performed for every crank angle (e.g., 360° CA.).

When this process is started, at Step 250, the intake air quantity Ga is input. Then, the rotational speed of the engine NE is input at Step 251. Then, at next Step 252, the ECU 9 judges whether or not the butterfly valve 41 is open. When the valve is open, the ECU 9 proceeds to Step 253, and constants $C_{1ON}$ and $C_{2ON}$ for the open position are searched for from a table for the open position shown in FIG. 33. At Step 254, the constants $C_{ON}$ and $C_{2ON}$, which are searched for at Step 253, are input into $C_1$ and $C_2$, respectively, and the ECU 9 proceeds to Step 257.

Figures 32, 33, 34:
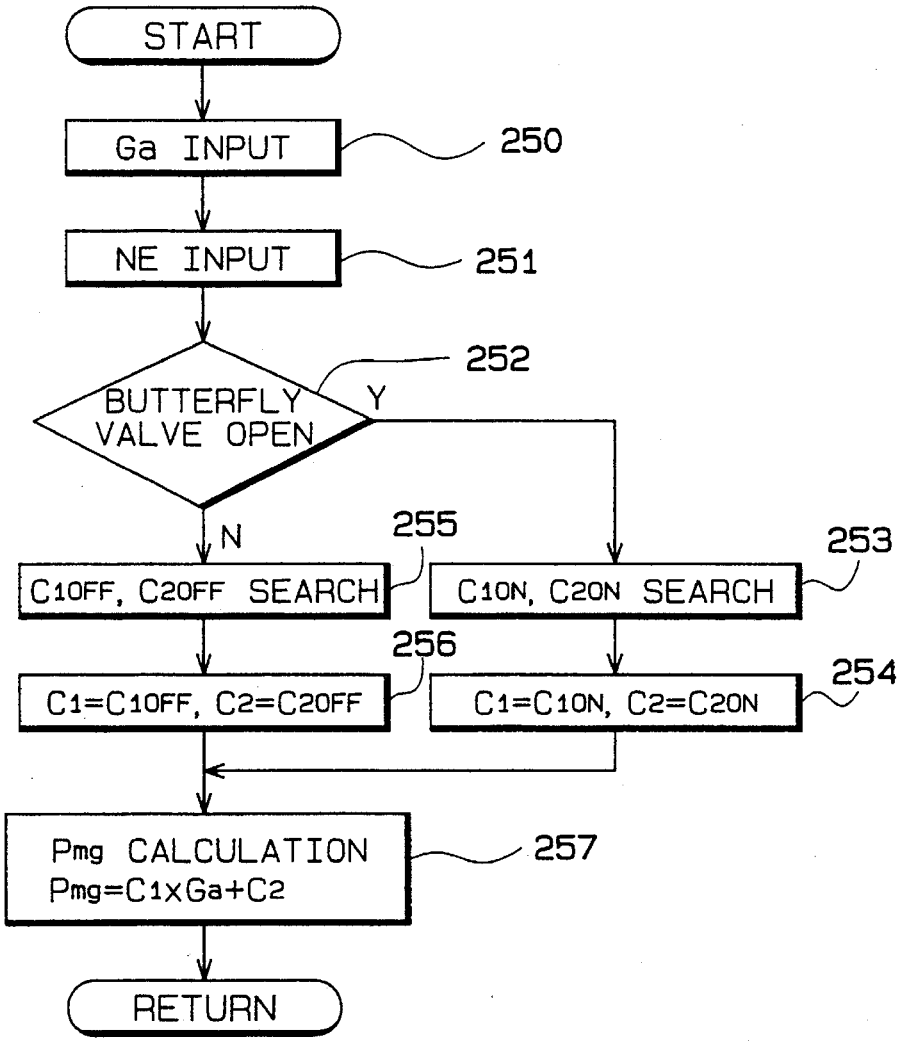
FIG. 32 is a flowchart showing the routine to be performed by the ECU 9 in the eighth embodiment.
FIG. 33 is a table for obtaining constants $C_{1ON}$ and $C_{ON}$ for open position of the butterfly valve 41 for estimating the intake pressure in the seventh embodiment.
FIG. 34 is a table for obtaining constants $C_{1OFF}$ and $C_{2OFF}$ for closed position of the butterfly valve 41 for estimating the intake pressure in the seventh embodiment.

On the other hand, at Step if the ECU 9 judges that the valve is closed, the ECU 9 proceeds to Step 255, and constants $C_{1OFF}$ and $C_{2OFF}$ for the closed position are searched for from a table for the closed position shown in FIG. 34. At Step 254, the constants $C_{10OFF}$ and $C_{2OFF}$, which are searched for at Step 255, are input into $C_1$ and $C_2$, respectively, and the ECU 9 proceeds to Step 257.

At Step 257, by using the constants $C_1$ and $C_2$ which are searched for at Step 253 or Step 255, the intake pressure $P_{mg}$ is obtained with Equations (25) and (26).

In this embodiment, while the application of the variable intake control apparatus for opening or closing the butterfly valve is explained, the present invention is not limited to such scope. As to an apparatus for changing the volume in the intake pipe, e.g. by changing the length of the intake pipe, this process is applicable by determining the value of constants $C_1$ and $C_2$ in accordance with the volume in the intake pipe. The process is also applicable to the other apparatus for changing the quantity and open timing of an intake valve. For example, as to an apparatus changing the quantity and open timing of the intake valve by switching the cam shaft, this process is applicable by determining the constants C1 and C2 for every cam shaft.

(NINTH EMBODIMENT)

Next, another embodiment estimating the intake pressure for an internal combustion engine equipped with a supply apparatus for supplying gas into the intake pipe not through air flow meter 29, e.g. EGR (Exhaust gas recirculation) control apparatus, is explained. When such supply apparatus supplies gas into the intake pipe, the intake pressure varies. Therefore, the intake air quantity detected by the air flow meter 29 and the intake pressure estimated by the operating condition of the engine at that time should be corrected.

Figure 35:
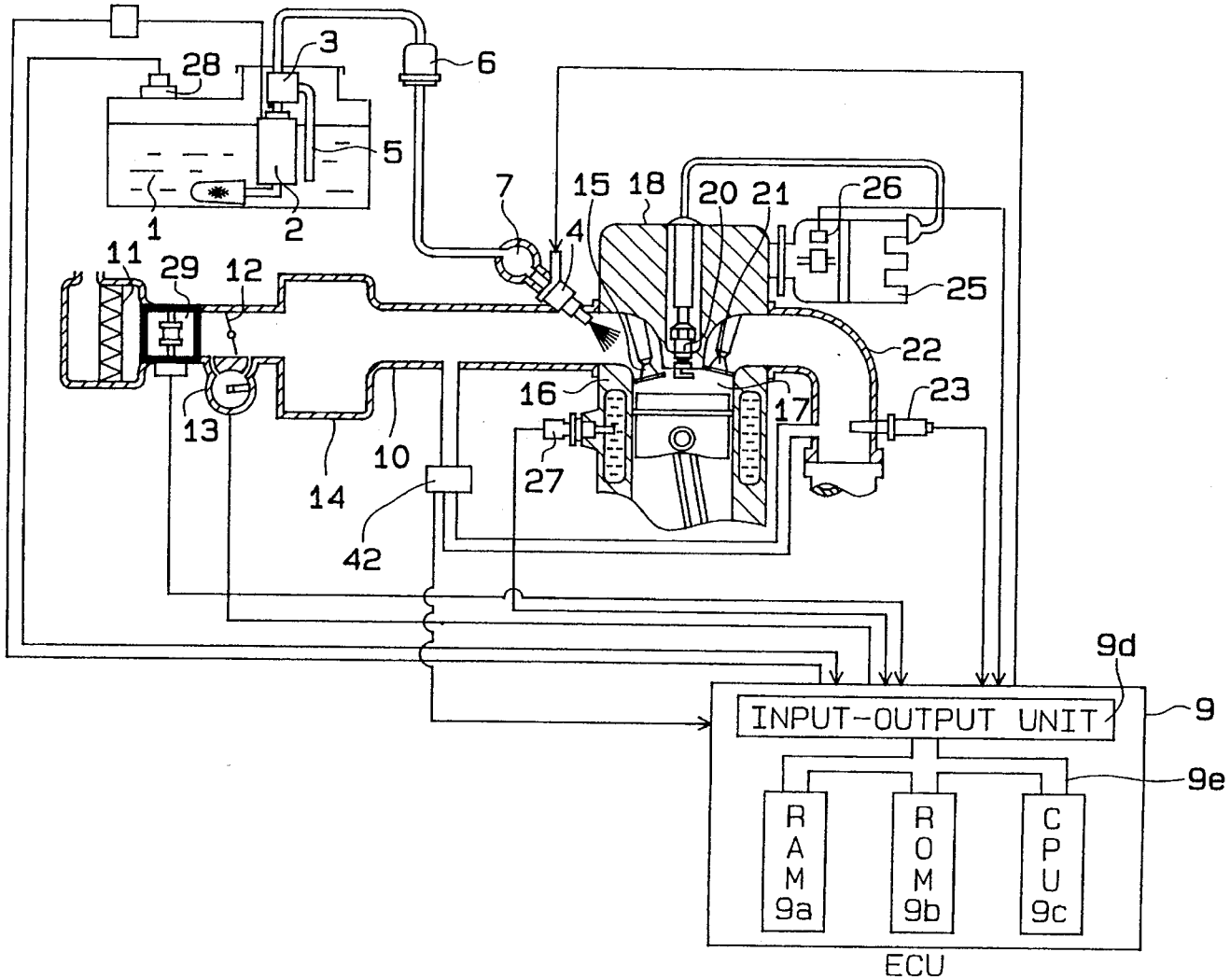
FIG. 35 is a view showing the configuration of the system of the ninth embodiment.

FIG. 35 is a schematic configuration view in which an EGR control apparatus is applied to the internal combustion engine shown in FIG. 6. In FIG. 35, the same components shown in FIG. 6 are indicated with same reference number, and these explanation is also omitted.

In FIG. 35, the numeral 42 indicates an EGR valve, and ECU 9 opens or closes the EGR valve 42 for introducing EGR gas from the exhaust pipe 22 into the intake pipe 10. By recirculating EGR gas into the intake pipe, nitrogen oxide (NOX) in the exhaust pipe is reduced.

Figure 36:
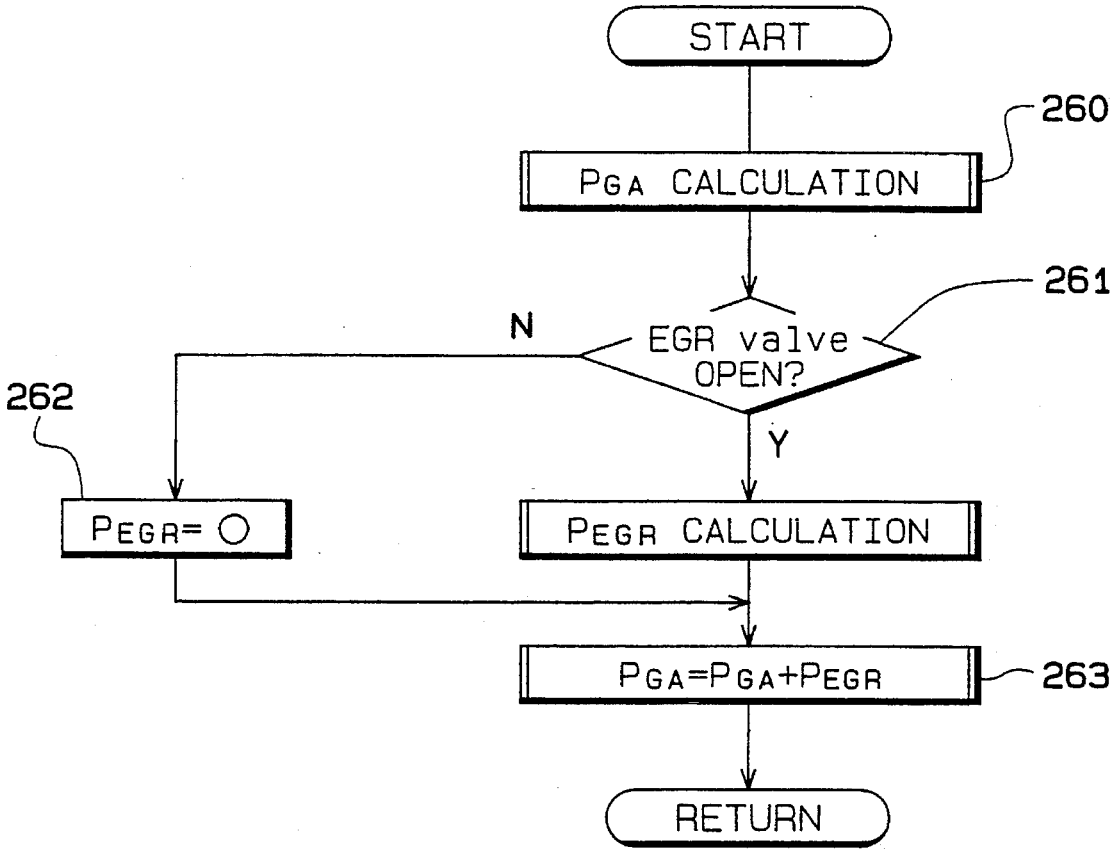
FIG. 36 is a flowchart showing the routine to be performed by the ECU 9 in the ninth embodiment.

However, as the pressure in the intake pipe increases when the EGR gas is introduced, the estimated intake pressure should be corrected according to the variation of the intake pressure. The correction process is explained with respect to the flowchart shown in FIG. 36. The process of this flowchart is performed for every crank angle (e.g., 360° CA.).

When this process is started, at Step 260, the estimated intake pressure based on the intake air quantity Ga and the rotational speed of the engine is input. Then, at next Step 261, the ECU 9 judges whether or not the EGR valve 42 is open, namely whether or not the EGR gas is introduced into the intake pipe 10. When the judgement is negative, the ECU 9 proceeds to Step 262 and judges that there is no intake pressure variation due to the introduction of the EGR gas, and the pressure increasing quantity (correction quantity) due to EGR gas is determined as 0. Then, the ECU 9 proceed to Step 263. At Step 261, if the judgment is positive, the ECU 9 proceeds to Step 262, and the variation quantity of the intake pressure $P_{EGR}$ due to the introduction of the EGR gas is obtained. The EGR gas quantity is determined by the operating condition of the engine.

Figure 37:
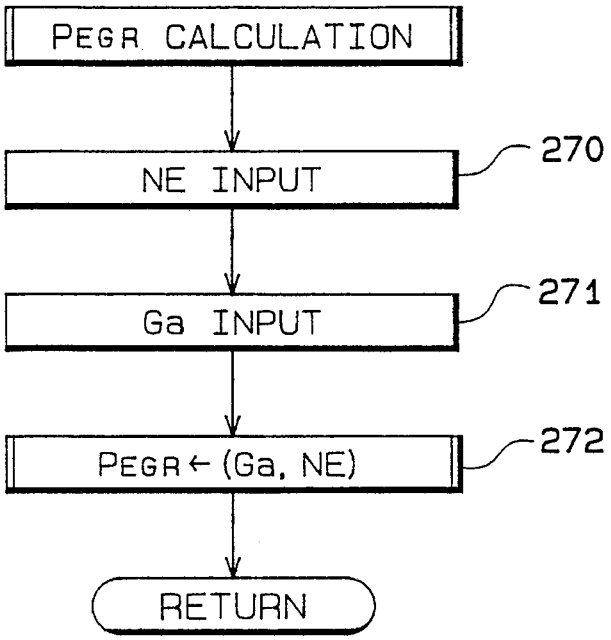
FIG. 37 is a flowchart showing the routine for calculating $P_{EGR}$ shown in FIG. 36.
Figure 38:
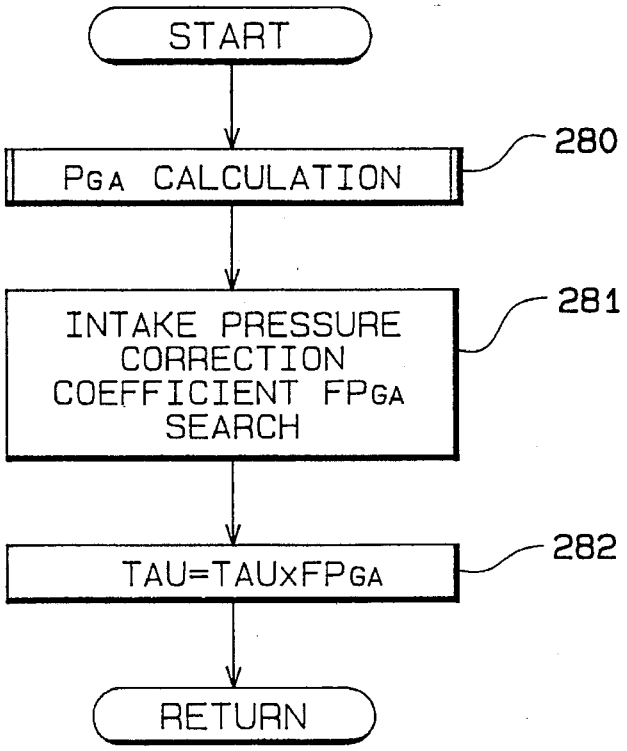
FIG. 38 is a flowchart showing the routine for correcting the fuel injection quantity in the ninth embodiment.

The flowchart for obtaining this pressure variation quantity $P_{EGR}$ is shown in FIG. 37. The process is explained with respect to this flowchart. First, at Step 270, the rotational speed of the engine NE is input. Next, at Step 271, the variation quantity of the intake pressure is obtained from two-dimensional table, which is prepared by the rotational speed of engine NE and intake air quantity Ga as parameter, by using the rotational speed of engine NE and intake air quantity Ga input at Steps 270 and 271, the process is terminated, and the ECU 9 proceeds to Step 263 shown in FIG. 36.

Then, the estimated intake pressure obtained at Step 260 is corrected by the following equation at Step 263.

$$P_{GA}=P_{GA}+P_{EGR}$$

By performing the above-process, even when the intake pressure varies due to the introduction of the EGR gas, the intake pressure is accurately estimated by performing correction according to such variation.

In the ninth embodiment, the application of the internal combustion engine equipped with the EGR control apparatus is explained. However, the present correction process is not limited to such scope and is also applicable to the other apparatus for introducing the gas into the intake pipe in which such gas is not measured by air flow meter such as a fuel evaporation control apparatus or an assisting air apparatus. That is, for such apparatus, in the same manner of this embodiment, by estimating the variation of the intake pressure when the gas is introduced into the intake pipe, the intake pressure estimated from the intake air quantity and rotational speed of the engine is corrected based on such variation.

In the ninth embodiment, the correction process applied to the internal combustion engine controlled by the process of estimating the intake pressure from intake air quantity and rotational speed of the engine is explained, the correction process of the intake pressure variation in the ninth embodiment is applied to, for example other embodiments, where the intake pressure is estimated from the throttle opening degree and rotational speed of the engine.

What is claimed is:

1. A fuel injection control apparatus for an internal combustion engine comprising:

a fuel tank for storing fuel to be supplied to said internal combustion engine;

a fuel injection valve disposed in an intake pipe of said engine for injecting fuel into said intake pipe;

a fuel pump for pumping fuel from said fuel tank to said fuel injection valve;

pressure regulating means disposed in a fuel supply pipe between said fuel pump and said fuel injection valve for regulating pressure of fuel supplied from said fuel pump to said fuel injection valve such that said pressure is proportional to a predetermined pressure, which is a pressure other than a pressure in said intake pipe, without returning fuel from said injection valve to said fuel tank;

intake pressure detecting means for detecting pressure in said intake pipe;

fuel injection quantity control means for controlling an amount of fuel supplied from said fuel injection valve to said internal combustion engine; and fuel injection quantity correcting means for correcting said amount of fuel supplied from said fuel injection valve based on a deviation of said fuel pressure regulated by said pressure regulating means from a proper value due to a differential pressure between said predetermined pressure of said pressure regulating means and said intake pressure.

2. A fuel injection control apparatus for an internal combustion engine according to claim 1, wherein said pressure regulating means is a mechanical pressure regulator which detects an atmospheric pressure and returns a portion of said fuel to said fuel tank when said pressure of said fuel supplied to said fuel injection valve becomes higher than said said predetermined pressure, which is based on said atmospheric pressure.

3. A fuel injection control apparatus for an internal combustion engine comprising:

a fuel tank for storing fuel to be supplied to said internal combustion engine;

a fuel injection valve disposed in an intake pipe of said engine for injecting fuel into said intake pipe;

a fuel pump for pumping fuel from said fuel tank to said fuel injection valve;

pressure regulating means disposed in a fuel supply pipe between said fuel pump and said fuel injection valve for regulating pressure of fuel supplied from said fuel pump to said fuel injection valve to be proportional to a predetermined pressure, which is a pressure other than a pressure in said intake pipe, without returning fuel from said injection valve into said fuel tank, said pressure regulating means including tank pressure detecting means for regulating said fuel pressure to be proportional to said fuel tank pressure and for detecting pressure in said fuel tank;

intake pressure detecting means for detecting pressure in said intake pipe;

fuel injection quantity control means for controlling an amount of fuel supplied from said fuel injection valve to said internal combustion engine; and fuel injection quantity correcting means for correcting said amount of fuel supplied from said fuel injection valve according to a deviation of said fuel pressure regulated by said pressure regulating means from a proper value due to a differential pressure between said predetermined pressure of said pressure regulating means and said intake pressure, said fuel injection quantity correcting means including means for correcting said fuel injection quantity based on a detection result by said tank pressure detecting means and said intake pressure detecting means.

4. A fuel injection control apparatus for an internal combustion engine comprising:

a fuel tank for storing fuel to be supplied to said internal combustion engine;

a fuel injection valve disposed in an intake pipe of said engine for injecting fuel into said intake pipe;

a fuel pump for pumping fuel from said fuel tank to said fuel injection valve;

pressure regulating means disposed in a fuel supply pipe between said fuel pump and said fuel injection valve for regulating pressure of fuel supplied from said fuel pump to said fuel injection valve to be constantly proportional to a predetermined pressure, which is a pressure other than pressure in said intake pipe, without returning fuel from said injection valve into said fuel tank;

intake air quantity detecting means for detecting quantity of air introduced into said intake pipe;

rotational speed detecting means for detecting rotational speed of engine;

intake pressure detecting means for detecting pressure in said intake pipe, said intake pressure detecting means including means for estimating intake pressure from said intake air quantity detected by said intake air quantity detecting means and said rotational speed of said engine detected by said rotational speed detecting means;

fuel injection quantity control means for controlling injection quantity of fuel to be supplied from said fuel injection valve to said internal combustion engine; and fuel injection quantity correcting means for correcting the fuel injection quantity of said fuel injection valve according to a deviation of said fuel pressure regulated by said pressure regulating means from a proper value due to a differential pressure between said predetermined pressure of said pressure regulating means and said intake pressure.

5. A fuel injection control apparatus for an internal combustion engine according to claim 1, further comprising:

intake air quantity detecting means for detecting quantity of air Ga which is introduced into said intake pipe;

operating condition detecting means for detecting operating condition of said engine; and constant determining means for determining first $C_1$ and second constants $C_2$ based on said operating condition by said operating condition detecting means, wherein said intake pressure detecting means includes intake pressure calculating means for calculating intake pressure $P_{mg}$ based on the following equation:

$P_{mg}=C_1 \times Ga+C_2$

6. A fuel injection control apparatus for an internal combustion engine according to claim 5, further comprising:

intake volume changing means for changing volume of said intake pipe, wherein said constant determining means includes determining means for determining said constants C1 and C2 based on operating condition of said intake volume changing means.

7. A fuel injection control apparatus for an internal combustion engine according to claim 1, further comprising:

gas supplying means for supplying gas into said intake pipe;

detecting means for detecting operating condition of said gas supplying means;

operating condition detecting means for detecting operating condition of said engine;

intake pressure variation amount calculating means for calculating variation amount in intake pressure from said operating condition of engine detected by said operating condition detecting means and said operating condition of said gas supplying means detected by said detecting means due to said operation of said gas supplying means; and intake pressure correcting means for correcting said intake pressure detected by said intake pressure detecting means based on variation amount calculated by said intake pressure variation amount calculating means.

8. A fuel injection control apparatus for an internal combustion engine according to claim 7, wherein said gas supplying means is an apparatus for supplying EGR gas into said intake pipe.

9. A fuel injection control apparatus for an internal combustion engine according to claim 7, wherein said gas supplying means is an apparatus for supplying assisting air into said intake pipe.

10. A fuel injection control apparatus for an internal combustion engine according to claim 7, wherein said gas supplying means is an apparatus for supplying fuel evaporation into said intake pipe.

11. A fuel injection control apparatus for an internal combustion engine according to claim 5, further comprising:

throttle valve disposed in said intake pipe for controlling quantity of air introduced into said internal combustion engine;

throttle opening detecting means for detecting opening degree of said throttle valve; and transition detecting means for detecting transition operating time of said internal combustion engine, wherein said intake pressure detecting means includes means for estimating intake pressure from said opening degree of said throttle valve and said rotational speed of said engine, means for detecting variation during a predetermined period of said intake pressure estimated from said throttle opening degree and said rotational speed of said engine, and intake pressure correcting means for correcting said intake pressure estimated from said intake air quantity and said rotational speed of said engine according to variation in said intake pressure estimated for said predetermined period from said opening degree of said throttle and said rotational speed of said engine when said transition operating time is detected by said transition operating detecting means.

12. A fuel injection control apparatus for an internal combustion engine according to claim 5, further comprising:

guarding means for determining that said intake pressure is value corresponding to atmospheric pressure when said intake pressure detected by said intake pressure detecting means is higher than substantial atmospheric pressure.

13. A fuel injection control apparatus for an internal combustion engine according to claim 5, wherein said internal combustion engine is equipped with a supercharger, and said fuel injection control apparatus further comprises guarding means for determining that said intake pressure is the maximum supercharging pressure when said intake pressure detected by said intake pressure detecting means is higher than the value corresponding to said maximum supercharging pressure.

14. A fuel injection control apparatus for an internal combustion engine according to claim 1, further comprising:

a throttle valve disposed in said intake pipe for controlling quantity of air introduced into said internal combustion engine;

throttle valve opening detecting means for detecting opening degree of said throttle valve;

intake air quantity detecting means for detecting quantity of air introduced into said intake pipe;

first estimating means for estimating first intake pressure from said opening degree of said throttle valve and said rotational speed of engine;

second estimating means for estimating second intake pressure from said intake air quantity and said rotational speed of engine; and atmospheric pressure estimating means for estimating atmospheric pressure from said first intake pressure and said second intake pressure, wherein said fuel injection quantity correcting means includes means for performing fuel injection quantity correction by using said atmospheric pressure estimating means.

15. A fuel injection control apparatus for an internal combustion engine comprising:

a fuel tank for storing fuel to be supplied to said internal combustion engine;

a fuel injection valve disposed in an intake pipe of said engine for injection fuel into said intake pipe;

a fuel pump for pumping fuel from said fuel tank to said fuel injection valve;

pressure regulating means disposed in one of said fuel tank and a fuel pipe in a vicinity of said fuel tank for regulating a pressure of fuel supplied form said fuel pump to said fuel injection valve such that said fuel pressure is proportional to a predetermined pressure, which is a pressure other than a pressure in said intake pipe;

operating condition detecting means for detecting an operating condition of said engine, which includes intake pressure detecting means for detecting a pressure in said intake pipe and rotational speed detecting means for detecting a rotational speed of said engine;

fuel injection quantity calculating means for calculating a fuel quantity to be injected from said fuel injection valve according to a detection result of said intake pressure detecting means and said rotational speed detecting means;

injection quantity correcting means for correcting said fuel injection quantity based on a detection result of said operating condition detecting means; and intake pressure correcting means for performing an intake pressure correction for correction parameters which are calculated irrespective of said intake pressure.

16. A fuel injection control apparatus for an internal combustion engine according to claim 15, wherein said fuel injection quantity calculating means includes injection time calculating means for calculating an injection time at which fuel is injected from said fuel injection valve, wherein said injection correcting means performs correction of said injection time.

17. A fuel injection control apparatus for an internal combustion engine according to claim 15, wherein said intake pressure correcting means includes selecting correction means for selecting correction parameters to be calculated in relation to intake pressure and said correction parameters calculated irrespective of said intake pressure, and said intake pressure correcting means performs intake pressure correction only for said correction parameters calculated irrespective of said intake pressure.

18. A fuel injection control apparatus for an internal combustion engine according to claim 15, wherein said intake pressure correcting means performs intake pressure correction for a parameter of an asynchronous injection.

19. A fuel injection control apparatus for an internal combustion engine according to claim 15, wherein said intake pressure correcting means performs intake pressure correction for a parameter of an air fuel ratio manual regulator.

20. A fuel injection control apparatus for an internal combustion engine according to claim 15, wherein said pressure regulating means is a mechanical pressure regulator which detects an atmospheric pressure and returns a portion of said fuel to said fuel tank when said pressure of said fuel supplied to said fuel injection valve becomes higher than said said predetermined pressure, which is based on said atmospheric pressure.

21. A fuel injection control apparatus for an internal combustion engine according to claim 16, wherein said pressure regulating means comprises tank pressure detecting means disposed in one of said fuel tank and said fuel pipe in said vicinity of said fuel tank for detecting pressure in said fuel tank, and said fuel injection quantity correcting means includes means for correcting said fuel injection quantity based on a detection result of said tank pressure detecting means and said intake pressure detecting means.

22. A fuel injection control apparatus for an internal combustion engine according to claim 20, wherein said pressure regulating means is disposed in said fuel supply pipe between said fuel pump and said fuel injection without returning fuel from said fuel injection valve into said fuel tank.

23. A fuel injection control apparatus for an internal combustion engine comprising:

a fuel tank for storing fuel to be supplied to said internal combustion engine;

a fuel injection valve disposed in an intake pipe of said engine for injecting fuel into said intake pipe;

a fuel pump for pumping fuel from said fuel tank to said fuel injection valve;

pressure regulating means disposed in one of said fuel tank and a fuel pipe in a vicinity of said fuel tank for regulating a pressure of fuel supplied from said fuel pump to said fuel injection valve such that said fuel pressure is proportional to a predetermined pressure, which is a pressure other than a pressure in said intake pipe;

operating condition detecting means for detecting an operating condition of said engine, which includes intake pressure detecting means for detecting a pressure in said intake pipe, rotational speed detecting means of detecting a rotational speed of said engine and high-temperature starting judging means for judging if said engine is in a high-temperature starting condition;

fuel injection quantity calculating means for calculating a fuel quantity to be injected from said fuel injection valve according to a detection result of said operating condition detecting means;

injection quantity correcting means for correcting said fuel injection quantity according to a differential pressure between said intake pressure detected by said intake pressure detecting means and said predetermined pressure of said pressure regulating means; and changing means for changing a correction amount determined by said injection quantity correcting means by increasing a fuel injection quantity when it is judged that said engine is in said high-temperature starting condition by said high-temperature starting judging means.

24. A fuel injection control apparatus for an internal combustion engines according to claim 23, wherein said changing means controls said fuel injection quantity correcting means so as to not correct said fuel injection quantity.

25. A fuel injection control apparatus for an internal combustion engines according to claim 23, wherein said changing means decreases said correction amount by said fuel injection quantity correcting means.

26. A fuel injection control apparatus for an internal combustion engine according to claim 23, wherein said pressure regulating means is a mechanical pressure regulator which detects an atmospheric pressure and returns a portion of said fuel to said fuel tank when said pressure of said fuel supplied to said fuel injection valve becomes higher than said said predetermined pressure, which is based on said atmospheric pressure.

27. A fuel injection control apparatus for an internal combustion engine according to claim 23, wherein said pressure regulating means comprises tank pressure detecting means disposed in one of said fuel tank and said fuel pipe in said vicinity of said fuel tank for detecting a pressure in said fuel tank, and said fuel injection quantity correcting means includes means for correcting said fuel injection quantity based on a detection result determined by said tank pressure detecting means and said intake pressure detecting means.

28. A fuel injection control apparatus for an internal combustion engine according to claim 23, wherein said pressure regulating means is disposed in a fuel supply pipe between said fuel pump and said fuel injection without returning fuel from said fuel injection valve into said fuel tank.

29. A fuel injection control apparatus for an internal combustion engines according to claim 23, wherein said intake pressure detecting means includes calculating means for calculating said intake pressure based on intake air quantity.

* * * * *

UNITED STATES PATENT AND TRADEMARK OFFICE

CERTIFICATE OF CORRECTION

PATENT NO. : 5,546,911

DATED : August 20, 1996

INVENTOR(S) : IWAMOTO et al.

It is certified that error appears in the above-identified patent and that said Letters Patent is hereby corrected as shown below:

On title page,

In Item [75], the first inventor's name should read --SHINICHI IWAMOTO-- not "SHINJI IWAMOTO".

Signed and Sealed this

Twenty-fourth Day of March, 1998

Bruce Lehman

*Attest:*

BRUCE LEHMAN

*Attesting Officer*

*Commissioner of Patents and Trademarks*